US007434565B2

(12) United States Patent
Miyachi

(10) Patent No.: US 7,434,565 B2
(45) Date of Patent: Oct. 14, 2008

(54) ELECTRONIC THROTTLE CONTROL APPARATUS

(75) Inventor: Kazutaka Miyachi, Ehime-ken (JP)

(73) Assignee: Denso Corporation, Kariya, Aichi-Pref. (JP)

( * ) Notice: Subject to any disclaimer, the term of this patent is extended or adjusted under 35 U.S.C. 154(b) by 265 days.

(21) Appl. No.: 11/370,169

(22) Filed: Mar. 8, 2006

(65) Prior Publication Data

US 2006/0213483 A1 Sep. 28, 2006

(30) Foreign Application Priority Data

Mar. 8, 2005 (JP) ..... 2005-064404

(51) Int. Cl.
*F02D 9/10* (2006.01)

(52) U.S. Cl. ..... 123/399; 123/361

(58) Field of Classification Search ..... 123/361, 123/399

See application file for complete search history.

(56) References Cited

U.S. PATENT DOCUMENTS

| | | | | |
|---|---|---|---|---|
| 5,078,110 | A * | 1/1992 | Rodefeld | 123/399 |
| 5,912,538 | A * | 6/1999 | Turner | 318/280 |
| 6,167,866 | B1 | 1/2001 | Jakisch et al. | |
| 6,431,144 | B1 * | 8/2002 | Daly | 123/399 |
| 6,641,111 | B2 | 11/2003 | Lorenz et al. | |
| 7,111,610 | B2 * | 9/2006 | Nidigattu | 123/399 |
| 7,114,487 | B2 * | 10/2006 | Hedrick et al. | 123/399 |

FOREIGN PATENT DOCUMENTS

| | | |
|---|---|---|
| JP | 6-42375 | 2/1994 |
| JP | 10-176548 | 6/1998 |
| JP | 10-238370 | 9/1998 |
| JP | 2000-87763 | 3/2000 |
| JP | 2000-320348 | 11/2000 |
| JP | 2003-214199 | 7/2003 |

* cited by examiner

*Primary Examiner*—Erick Solis
(74) *Attorney, Agent, or Firm*—Nixon & Vanderhye PC

(57) ABSTRACT

The electronic throttle control apparatus for a vehicle engine includes a throttle actuator including an electric motor generating torque for driving a throttle valve in an opening direction and a closing direction of the throttle valve through a transmission gear device a throttle opening degree sensor detecting an opening degree of the throttle valve, and a throttle control unit controlling the electric motor such that opening degree of the throttle valve detected by the throttle opening degree sensor becomes equal to a target throttle opening degree. The throttle control unit includes an icing decision function deciding whether or not the throttle valve is in a frozen state where icing is present in the throttle valve, and a deicing control function executing a freeze recovery process for recovering, when the throttle valve is decided to be in the frozen state by the icing decision function, the throttle valve from the frozen state by controlling the electric motor to drive the throttle valve in one of the closing direction and the opening direction at least by an amount of a clearance of the transmission gear device, and then in the other of the opening direction and the closing direction.

59 Claims, 15 Drawing Sheets

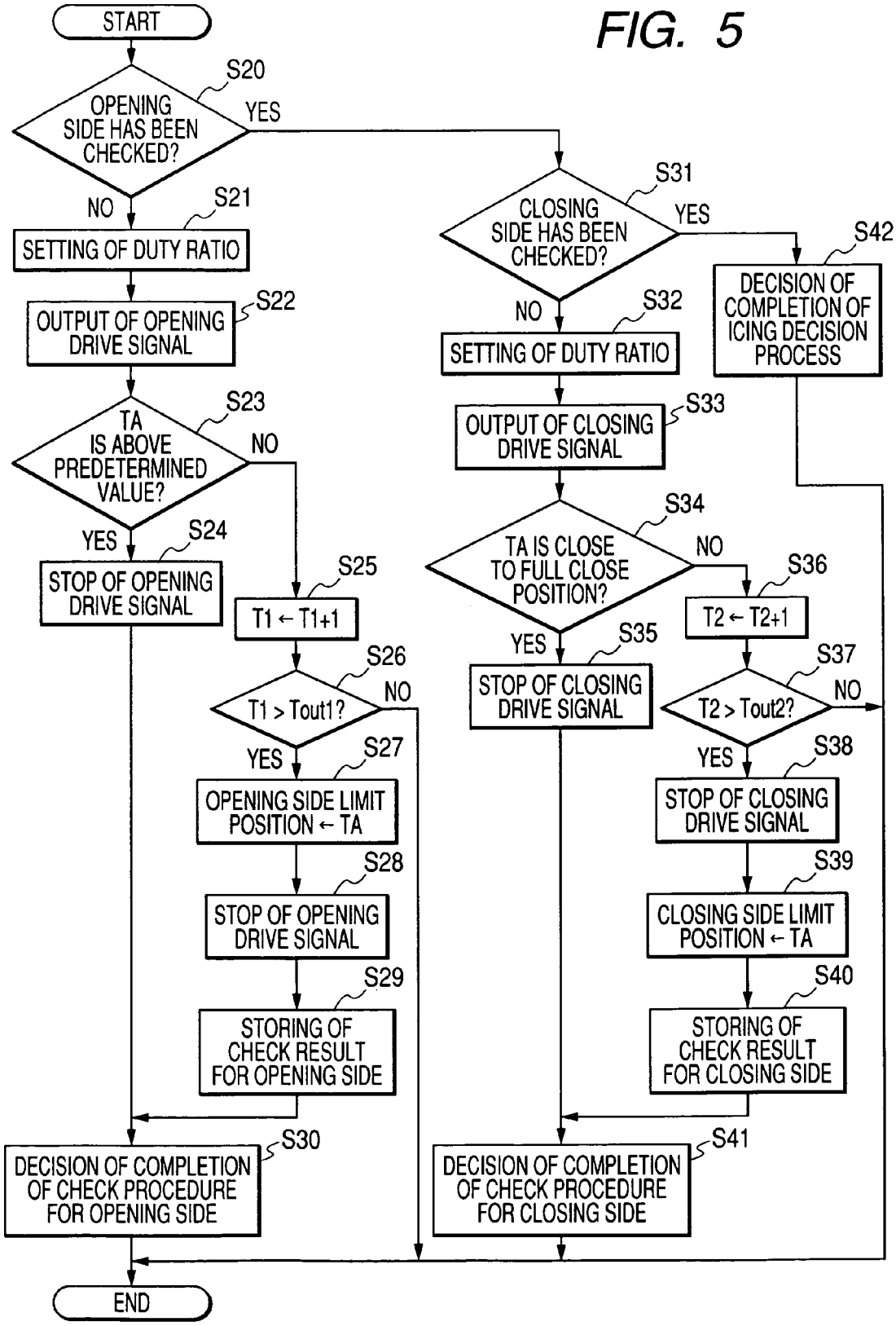
FIG. 5
START
S20
OPENING SIDE HAS BEEN CHECKED?
YES
NO
S21
SETTING OF DUTY RATIO
S22
OUTPUT OF OPENING DRIVE SIGNAL
S23
TA IS ABOVE PREDETERMINED VALUE?
NO
YES
S24
STOP OF OPENING DRIVE SIGNAL
S25
T1 ← T1+1
S26
T1 > Tout1?
NO
YES
S27
OPENING SIDE LIMIT POSITION ← TA
S28
STOP OF OPENING DRIVE SIGNAL
S29
STORING OF CHECK RESULT FOR OPENING SIDE
S30
DECISION OF COMPLETION OF CHECK PROCEDURE FOR OPENING SIDE
S31
CLOSING SIDE HAS BEEN CHECKED?
YES
NO
S32
SETTING OF DUTY RATIO
S33
OUTPUT OF CLOSING DRIVE SIGNAL
S34
TA IS CLOSE TO FULL CLOSE POSITION?
NO
YES
S35
STOP OF CLOSING DRIVE SIGNAL
S36
T2 ← T2+1
S37
T2 > Tout2?
NO
YES
S38
STOP OF CLOSING DRIVE SIGNAL
S39
CLOSING SIDE LIMIT POSITION ← TA
S40
STORING OF CHECK RESULT FOR CLOSING SIDE
S41
DECISION OF COMPLETION OF CHECK PROCEDURE FOR CLOSING SIDE
S42
DECISION OF COMPLETION OF ICING DECISION PROCESS
END

ELECTRONIC THROTTLE CONTROL APPARATUS

CROSS-REFERENCE TO RELATED APPLICATION

This application is related to Japanese Patent Application No. 2005-064404 filed on Mar. 8, 2005, the contents of which are hereby incorporated by reference.

BACKGROUND OF THE INVENTION

1. Field of the Invention

The present invention relates to an electronic throttle control apparatus for controlling an opening degree of a throttle valve by driving, through an electric motor, the throttle valve located in an air inlet passage of an internal combustion engine of a vehicle.

2. Description of Related Art

There is known, as disclosed in Japanese Patent Application Laid-open No. 2000-320348, a throttle control apparatus having a configuration in which a target opening degree of a throttle valve is oscillated within a certain angular range that does not affect starting characteristic of an engine during its starting period before the engine begins complete explosion, if there is a possibility that ice pieces have been formed in the throttle valve.

Since an output torque of a vehicle engine during its starting period does not vary so much even when a throttle valve is oscillated widely, it becomes possible to remove ice pieces from the throttle valve by oscillating the throttle valve.

However, in a case where the ice pieces formed in the throttle valve stick to an inner surface of an air inlet pipe at a binding force larger than a throttle valve driving force of an electric motor, there is a possibility that the throttle valve cannot recover from the frozen state thereof, that is, the ice pieces cannot be removed from the throttle valve even if the target opening degree of the throttle valve is oscillated during the engine starting period.

SUMMARY OF THE INVENTION

The present invention provides an electronic throttle control apparatus for a vehicle engine including:

a throttle actuator including an electric motor generating torque for driving a throttle valve in an opening direction and a closing direction of the throttle valve through a transmission gear device;

a throttle opening degree sensor detecting an opening degree of the throttle valve; and a throttle control unit controlling the electric motor such that opening degree of the throttle valve detected by the throttle opening degree sensor becomes equal to a target throttle opening degree;

wherein the throttle control unit includes an icing decision function deciding whether or not the throttle valve is in a frozen state where icing is present in the throttle valve, and a deicing control function executing a freeze recovery process for recovering, when the throttle valve is decided to be in the frozen state by the icing decision function, the throttle valve from the frozen state by controlling the electric motor to drive the throttle valve in one of the closing direction and the opening direction at least by an amount of a clearance of the transmission gear device, and then in the other of the opening direction and the closing direction.

The electronic throttle control apparatus of the invention is configured to control the electric motor to drive the throttle valve in one of the closing direction and the opening direction of the throttle valve at least by an amount of a clearance (play) of the transmission gear device for transmitting torque from the electric motor to the throttle valve, and then in the other of the opening direction and the closing direction so that the throttle valve hits an ice piece. Since the electric motor can build up speed at least for the time period during which it rotates by the amount of the gear clearance, it becomes possible for the electric motor to apply a large drive force to the throttle valve, to thereby improve deicing capability.

BRIEF DESCRIPTION OF THE DRAWINGS

In the accompanying drawings:

FIG. 5 is a flowchart showing contents of a freeze-decision process included in the freeze recovery control process;

PREFERRED EMBODIMENTS OF THE INVENTION

Figure 1:
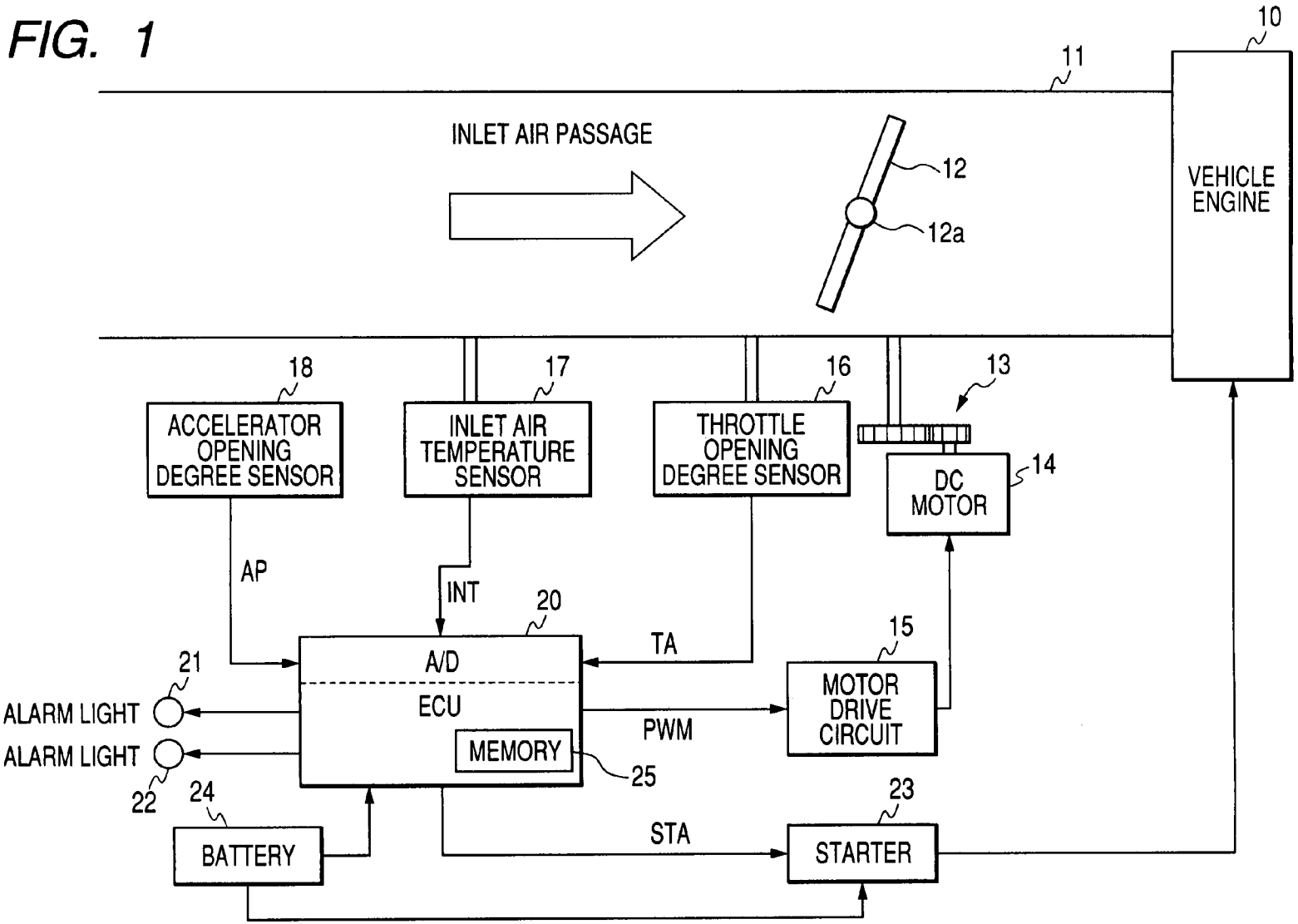
FIG. 1 is a diagram showing a structure of an electronic throttle control apparatus for use in a vehicle according to an embodiment of the invention.

FIG. 1 is a diagram showing a structure of an electronic throttle control apparatus 100 for use in a vehicle according to an embodiment of the invention. The electronic throttle control apparatus 100 includes throttle valve ECU (Electronic Control Unit) 20, an accelerator opening degree sensor 18, an inlet air temperature sensor 17, a throttle opening degree sensor 16, a speed reduction device 13, a DC motor 14, a motor drive circuit 15, a first alarm light 21, and a second alarm light 22.

As shown in FIG. 1, an air inlet pipe 11 of an internal combustion engine (vehicle engine) 10 is provided with a throttle valve 12 for adjusting a flow volume of inlet air sucked into the engine 10. Although not shown in this figure, an air cleaner and an air flow meter are disposed upstream of the air inlet pipe 11.

A pivot 12*a* of the throttle valve 12 is coupled to the DC motor 14 serving as a throttle actuator through the speed reduction device 13 constituted by gears. The opening degree of the throttle valve 12 (throttle opening degree) is controlled by a driving force transmitted from the motor 14 to the pivot 12*a* of the throttle valve 12 through the speed reduction device 13.

The motor 14 outputs a torque as a throttle valve driving force in response to a drive signal (duty signal) received from the motor drive circuit 15 including switching elements which operate to generate the drive signal in accordance with a PWM control signal outputted from the throttle valve ECU 20.

The throttle opening degree sensor 16, which is disposed in the vicinity of the pivot 12*a* of the throttle valve 12, generates a throttle opening degree detection signal TA indicative of the throttle valve opening degree. The inlet air temperature sensor 17 generates an inlet air temperature signal INT indicative of the temperature of the air in the air inlet pipe 11. The accelerator opening degree sensor 18 generates an accelerator opening degree detection signal AP indicative of an opening degree of an accelerator pedal pressed down by a vehicle driver. The throttle opening degree detection signal TA, the inlet air temperature signal INT, and the accelerator opening degree detection signal AP are supplied to the throttle ECU 20.

Although not shown in this figure, the engine 10 is provided with an engine ECU which controls an amount of fuel injected by an injector and ignition timing of spark plugs on the basis of the flow volume of the inlet air, engine speed, cooling water temperature, accelerator opening degree, etc. in order that the engine 10 outputs a target torque. The throttle ECU 20 and the engine ECU communicate with each other in order to exchange data therebetween. The throttle ECU20 may include the functions which the engine ECU provides.

The throttle ECU 20, which is a microcomputer-based unit constituted by a CPU, ROM, RAM etc., is provided with an A/D converter converting signals received from the above described sensors into digital signals. The CPU performs various routine programs for throttle control stored in the ROM.

More specifically, the throttle ECU 20 calculates a final target throttle opening degree by adding an ISC target throttle opening degree (a target throttle opening degree in idle speed control) to a selected one of a driver's demanding target throttle opening degree determined by the accelerator opening degree detection signal AP, a traction target throttle opening degree set in a traction control, and a constant-speed target throttle opening degree set in a constant speed drive control (cruise control). And the throttle ECU 20 performs a feedback control such that an actual throttle opening degree detected by the throttle opening degree sensor 16 becomes equal to the final target throttle opening degree by commanding the motor drive circuit 15 to perform a control (PID control, for example) over the motor 14.

The first and second warning lights 21, 22 connected to the throttle ECU 20 are for notifying vehicle passengers that the vehicle engine is prohibited from starting during execution of a specific process for recovering the throttle valve 12 from frozen state thereof (described later), or a specific fail-safe process different from a normal engine control process.

The throttle ECU 20 is also provided with a voltage level detector circuit detecting a voltage level of a vehicle battery supplying electric power to the throttle ECU 20. The throttle ECU 20 is configured to supply a starter 23 for starting the engine 10 with a start control signal STA which commands prohibition of or permission for engine start.

Figure 2A:
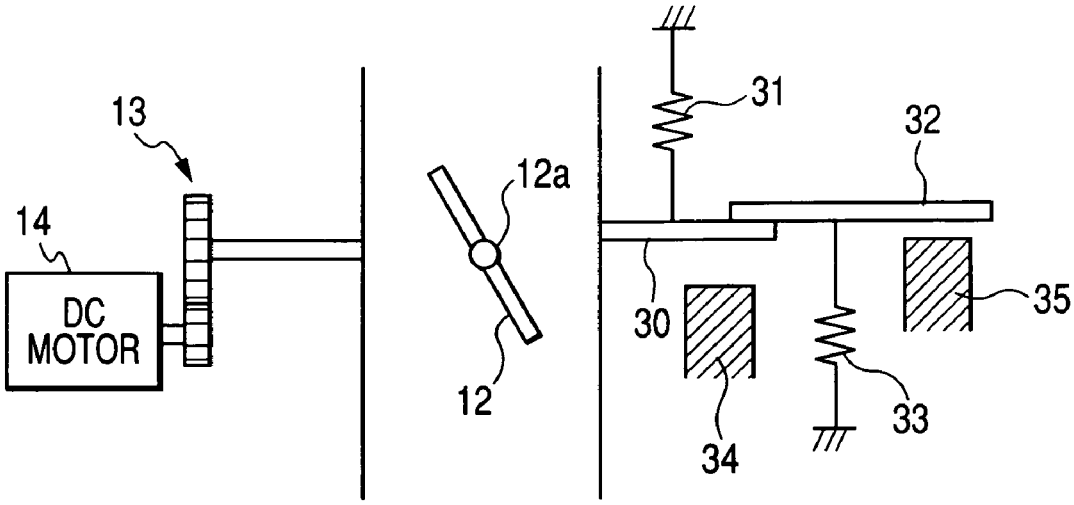
FIG. 2A is a diagram explaining a drive mechanism of a throttle valve when a motor for driving the throttle vale is energized.

Next, the structure of the throttle valve 12 is explained with reference to FIGS. 2A and 2B. A valve lever 30, which is biased towards an opening direction of the throttle valve 12 by an opener spring 31, is coupled to the pivot 12*a* of the throttle valve 12 at one end thereof. An opener 32, which is biased towards a closing direction of the throttle lever 12 by a return spring 33, is disposed so as to engage with the other end of the valve lever 30. The pulling force of the return spring 33 is set larger than that of the opener spring 31.

When a normal control is in execution (when the motor 14 operates in response to the drive signal), the motor 14 rotates in a forward direction or in a reverse direction depending on the accelerator opening degree detection signal AP to adjust the opening degree of the throttle valve 12 (throttle opening degree). The throttle opening degree when the normal control is in execution is detected by the throttle opening degree sensor 16. To increase the throttle opening degree, the motor 14 rotates in the forward direction, as a result of which the valve lever 30 swings while pushing the opener 32 against the pulling force of the return spring 33 to drive the throttle valve 12 in the opening direction (see FIG. 2A). Although not shown in FIGS. 2A and 2B, a throttle full open stopper is provided in the side of the valve lever 30 or in the side of the opener 32, so that, when the valve lever 30 or the opener 32 abuts against the throttle full open stopper, the valve lever 30 is prohibited from further swinging.

On the other hand, to decrease the throttle opening degree, the motor 14 rotates in the reverse direction, as a result of which the valve lever 30 swings against the pulling force of the opener spring 31 to drive the throttle valve 12 in the closing direction. When the throttle valve 12 is fully closed, since the valve lever 30 abuts against a throttle full close stopper 34, the valve lever 30 is prohibited from further swinging.

Figure 2B:
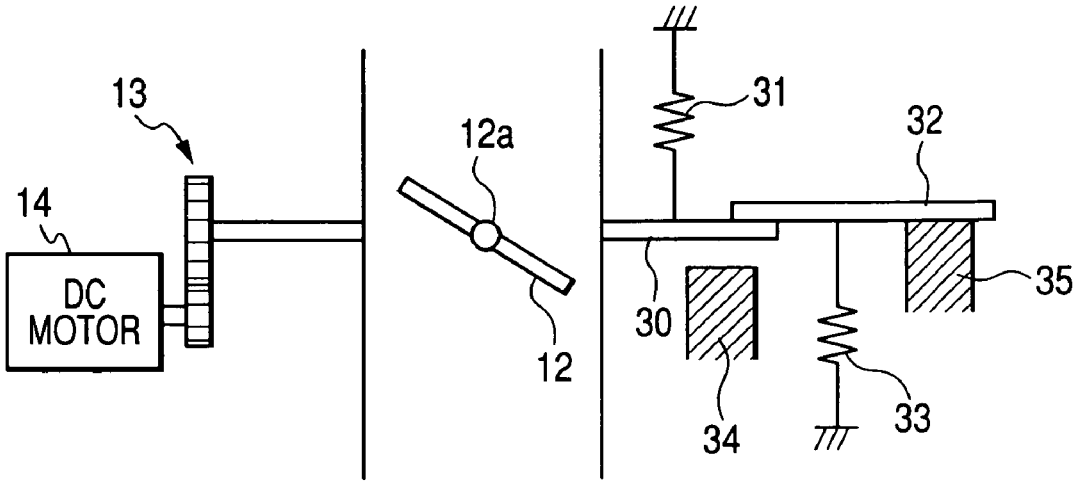
FIG. 2B is a diagram explaining the drive mechanism of the throttle valve when the motor for driving the throttle vale is deenergized.

When the motor 14 is not supplied with the drive signal, the opener 32 is kept at rest on an opener stopper 35, because the pulling force of the return spring 33 is larger than the pulling force of the opener spring 31 (see FIG. 2B). In this state where the position of the opener 32 is defined by the opener stopper 35, the angular position of the valve lever 30 corresponding to the throttle opening degree is kept at a certain value (between 5 and 10 degrees, for example), which is referred to as "initial opening degree" hereinafter.

Accordingly, the throttle valve 12 is not at a fully closed position but kept at the initial opening degree position when the vehicle is parked. This configuration makes it possible to take air into the engine to thereby enable an evacuation drive even when the throttle valve 12 is stuck due to presence of icing in the throttle valve 12.

Next, the control process for recovering the throttle valve 12 from its frozen state (referred to as "freeze recovery control process" hereinafter) is explained with reference to a flowchart of FIG. 3. This freeze recovery control process is executed at a certain timing, for example, each time an ignition switch is changed to an ACC position (accessory position) to start supplying electric power to the throttle ECU 20.

Figure 3:
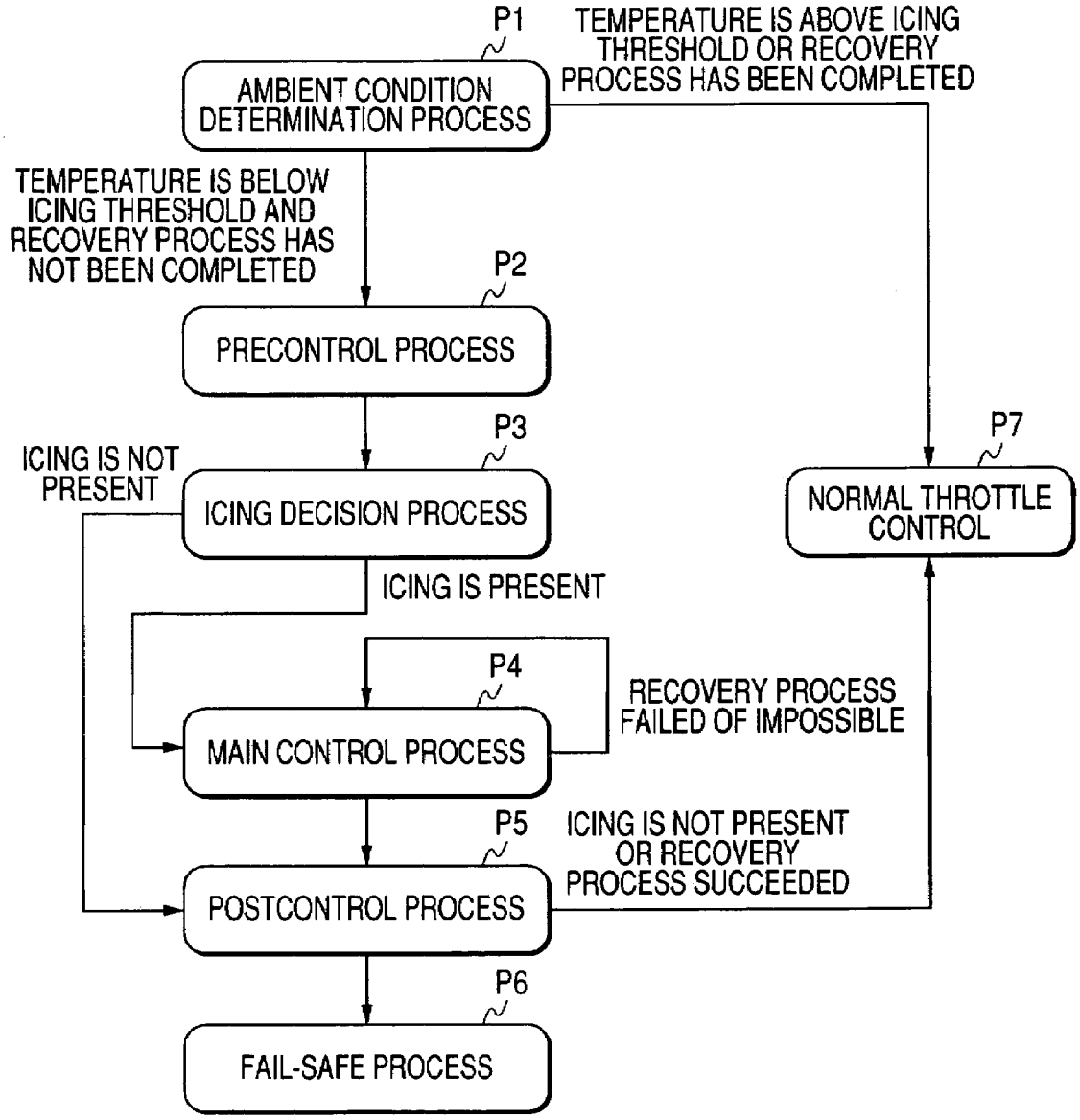
FIG. 3 is a state transition diagram showing transition of state of the freeze recovery control process for recovering from a frozen state of the throttle valve.

As shown in FIG. 3, the freeze recovery control process includes an ambient condition determination process P1, a precontrol process P2, an icing decision process P3, a main control process P4, a postcontrol process P5, and a fail-safe process P6.

In the ambient condition determination process P1, it is checked whether or not the ambient temperature of the throttle valve 12 is low enough for icing to occur in the throttle valve 12. More specifically, if the ambient temperature of the throttle valve 12 is lower than a predetermined icing threshold temperature Tice, it is determined that there is a possibility that the throttle valve 12 has at least one ice piece formed thereinside, and that the precontrol processP2 should be executed.

Figure 11:
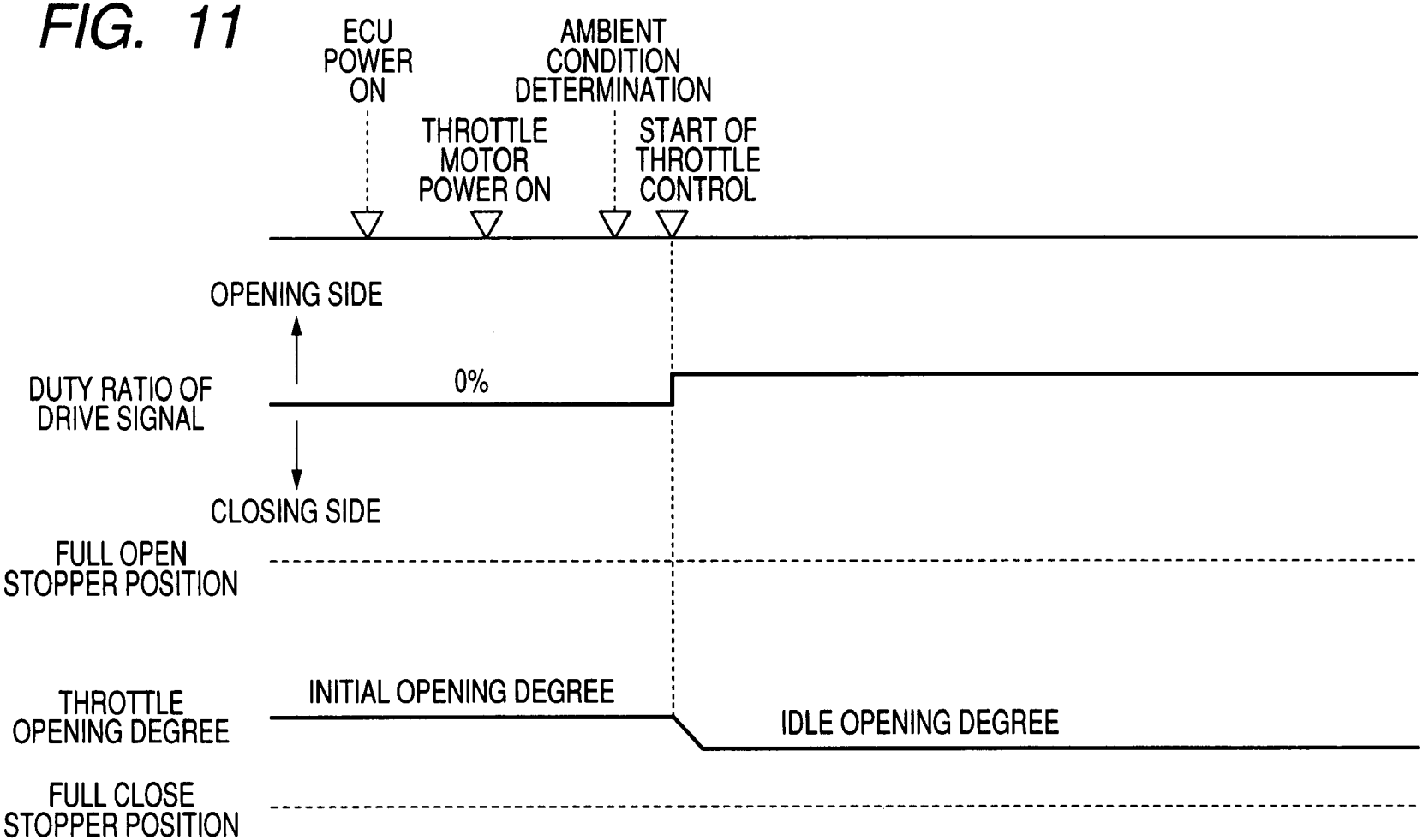
FIG. 11 is a diagram showing an example of temporal changes of a duty ratio of a drive signal applied to the motor for driving the throttle vale, and a throttle opening degree when a normal throttle control is performed.

The inlet air temperature signal INT outputted from the inlet air temperature sensor 17 is used to determine the ambient temperature of the throttle valve 12. Alternatively, as the ambient temperature of the throttle valve 12, a temperature of engine cooling water may be used if the engine 10 is provided with a sensor for detecting such an engine cooling water temperature In the ambient condition determination process P1, it is also checked whether or not the main control process P4 has been already executed. If it is determined in the ambient condition determination process P1 that the ambient temperature of the throttle valve 12 is not lower than the icing threshold temperature Tice, or that the throttle valve 12 has already been recovered from the frozen state thereof by executing the main control process P4, then a normal throttle control P7 is performed. FIG. 11 is a diagram showing temporal changes of the duty ratio of the drive signal, and the throttle opening degree when the normal throttle control P7 is performed.

As shown in FIG. 11, when the duty ratio of the drive signal applied to the motor 14 is 0%, that is, when the motor 14 is not supplied with electric power, the throttle valve 12 is kept at the initial opening degree position. In this state, if it is determined in the ambient condition determination process P1 that there is no possibility of presence of icing in the throttle valve 12, then the normal throttle control P7 is performed immediately. In this case, the throttle opening degree is controlled in accordance with the duty ratio of the drive signal depending on the driver's demanding target throttle opening degree and the ISC target throttle opening degree.

On the other hand, if it is determined in the ambient condition determination process P1 that the ambient temperature of the throttle valve 12 is lower than the icing threshold temperature Tice, and that the main control process P4 has not been executed yet, then the precontrol process P2 is executed.

Figure 4:
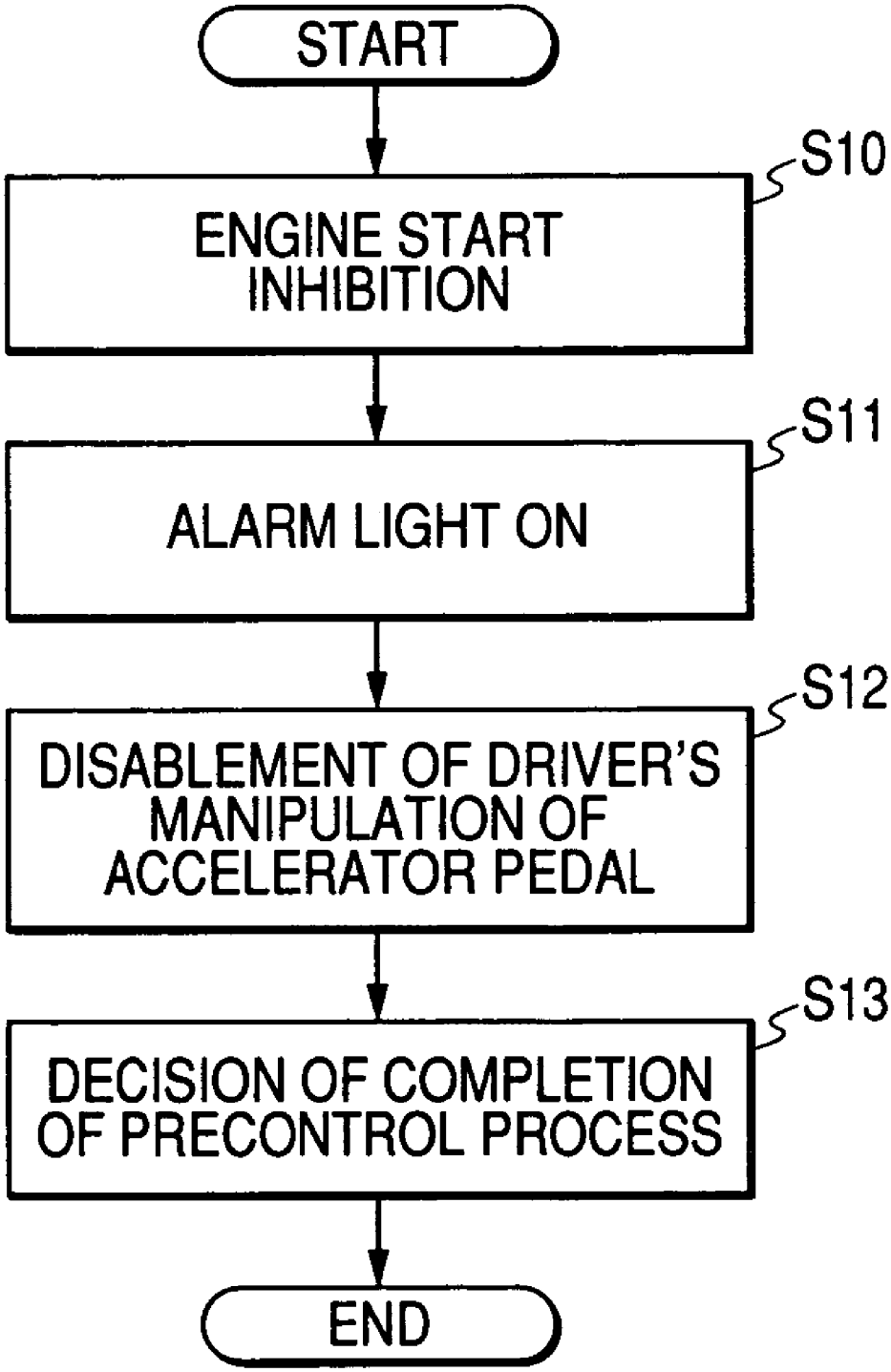
FIG. 4 is a flowchart showing contents of a precontrol process included in the freeze recovery control process.

FIG. 4 is a flowchart showing detailed contents of the precontrol process P2. As shown in FIG. 4, the precontrol process P2 begins by inhibiting the engine 10 from starting at step S10 to avoid contingency from occurring. More specifically, the throttle ECU 20 sends a start prohibition command to the starter 23 by use of the start control signal STA. This inhibition processing makes it possible to avoid a situation in which the vehicle starts to travel against the driver's intention, or the traveling state of the vehicle changes unexpectedly due to change of the throttle opening degree as a result of execution of the main control process P4 or later processes.

This inhibition processing is not limited to sending the start prohibition command to the starter 23. For example, the inhibition processing may be such that the throttle ECU 20 sends an ignition stop command or fuel injection stop command to the engine ECU.

Incidentally, it is possible to avoid such a situation also by configuring the throttle ECU 20 to instruct a clutch mechanism to interrupt torque transmission from the engine 10 to vehicle wheels, or instruct a brake mechanism to apply a braking force to the vehicle wheels in order to keep the vehicle parked irrespective of the output torque of the engine 10.

At subsequent step S11, the first alarm light 21 is put on to notify the vehicle passengers of the fact that the engine 10 is in a state where it is prohibited from starting.

Preferably, the electronic throttle control apparatus of this embodiment is provided with a speaker device to enable instructing by voice the vehicle passengers to refrain from starting the engine 10 when the engine 10 is in such a state.

At subsequent step S12, the driver's demand on the throttle valve opening degree, that is, the driver's manipulation of the accelerator pedal is disabled. Consequently, the calculation of the driver's demanding target throttle opening degree on the basis of the accelerator opening degree detection signal AP outputted from the accelerator opening degree sensor 18, and the execution of the feedback control by use of the driver's demanding target throttle opening degree are halted. This avoids mutual interference between the operation on the throttle valve 12 performed by the main control process P4 or later processes and the operation on the throttle valve 12 performed by the vehicle driver, which may degrade the recoverability of the throttle valve 12 from its frozen state.

At step S13, the fact that the precontrol process P2 has been completed is memorized in a memory 25 (see FIG. 1) by use of a flag or the like.

After execution of the precontrol process P2, the icing decision process P3 is executed. In the icing decision process P3, the motor 14 generates torques for driving the throttle valve 12 in the opening direction and closing direction to move from the initial opening degree position (may be referred to as initial position hereinafter). The throttle opening degree sensor 16 detects an opening degree of the throttle valve 12 when it has been driven in the closing direction and an opening degree of the throttle valve 12 when it has been driven in the opening direction, so that presence of icing in the throttle valve 12 can be determined in each of the opening side and the closing side of the throttle valve 12 individually.

FIG. 5 is a flowchart showing detailed contents of the icing decision process P3. As shown in FIG. 5, the icing decision process P3 begins by checking at step S20 whether or not presence of icing on the opening side of the throttle valve 12 has been already determined. The process moves to step S21 if the check result at step S20 is negative, and moves to step S31 if the check result at step S20 is affirmative.

At step S21, the duty ratio of the drive signal to be applied to the motor 14 to drive the throttle valve 12 in the opening direction to move from the initial position (referred to as "opening drive signal" hereinafter) is determined.

At step S22, the opening drive signal having the duty ratio determined at step S21 is applied to the motor 14. At step S23, it is checked whether or not the throttle opening degree detection signal TA indicates that the opening degree of the throttle valve 12 is larger than a predetermined icing threshold for the opening side of the throttle valve 12. If the check result at step S23 is affirmative, the application of the opening drive signal to the motor 14 is stopped at step 24, while assuming that there is no ice piece formed on the opening side of the throttle valve 12.

It should be noted that the motor 14 is controlled at step S22 to generate a torque such that the throttle valve 12 is driven within a predetermined driven range within which the throttle valve 12 does not hit the full open stopper. The above described icing-determination threshold is set smaller than the upper limit of the driven range.

On the other hand, if the check result at step S23 is negative, the process moves to step S25 where a count value of a counter T1 is incremented by one. At subsequent step S26, it is checked whether or not the count value of the counter T1 is larger than a predetermined value Tout1. If the check result at step S26 is negative, the process is temporarily ended, and after an elapse of a predetermined time, this process is executed again.

Accordingly, steps S22, S23, S25, and S26 continue to be executed to check whether or not the opening degree of the throttle valve 12 represented by the throttle opening degree detection signal TA has exceeded the icing threshold as long as a time equivalent to Tout1 does not elapse.

If it is determined at step S26 that the count value of the counter T1 is larger than the value Tout1, it means that the opening degree of the throttle valve 12 has not reached a position corresponding to the icing threshold before elapse of a predetermined time period. In this case, the process moves to step S27 while assuming that icing is not present on the opening side of the throttle valve 12. At step S27, the value of the throttle opening degree detection signal TA outputted from the throttle opening degree sensor 16 is memorized as an opening side limit position. After that, the application of the opening drive signal to the motor 14 is stopped at step S28, and then the check result indicating that icing is present on the opening side of the throttle valve 12 is memorized at step S29.

After the application of the opening drive signal to the motor 14 is stopped at step S24, or after the check result indicating that icing is present on the opening side of the throttle valve 12 is memorized at step S29, the process moves to step S30 where the fact that the icing check procedure on the opening side of the throttle valve 12 has been completed is memorized.

After that, when the icing decision process P3 is initiated again, and the step S20 is executed, it is determined at step S20 that the icing check procedure on the opening side of the throttle valve 12 has been already executed, and accordingly the process moves to step S31 where it is checked whether or not an icing check procedure on the closing side of the throttle valve 123 has been executed. If the check result at step S31 is negative, steps 32 to S41 are executed to check whether or not icing is present on the closing side of the throttle valve 12. Since the icing check procedure on the closing side is much the same as that on the opening side, explanation on steps S32 to steps S41 is omitted.

After the icing check procedures on both the opening side and the closing side are finished, the fact that the icing decision process P3 has been completed is memorized at step S42.

Figure 12:
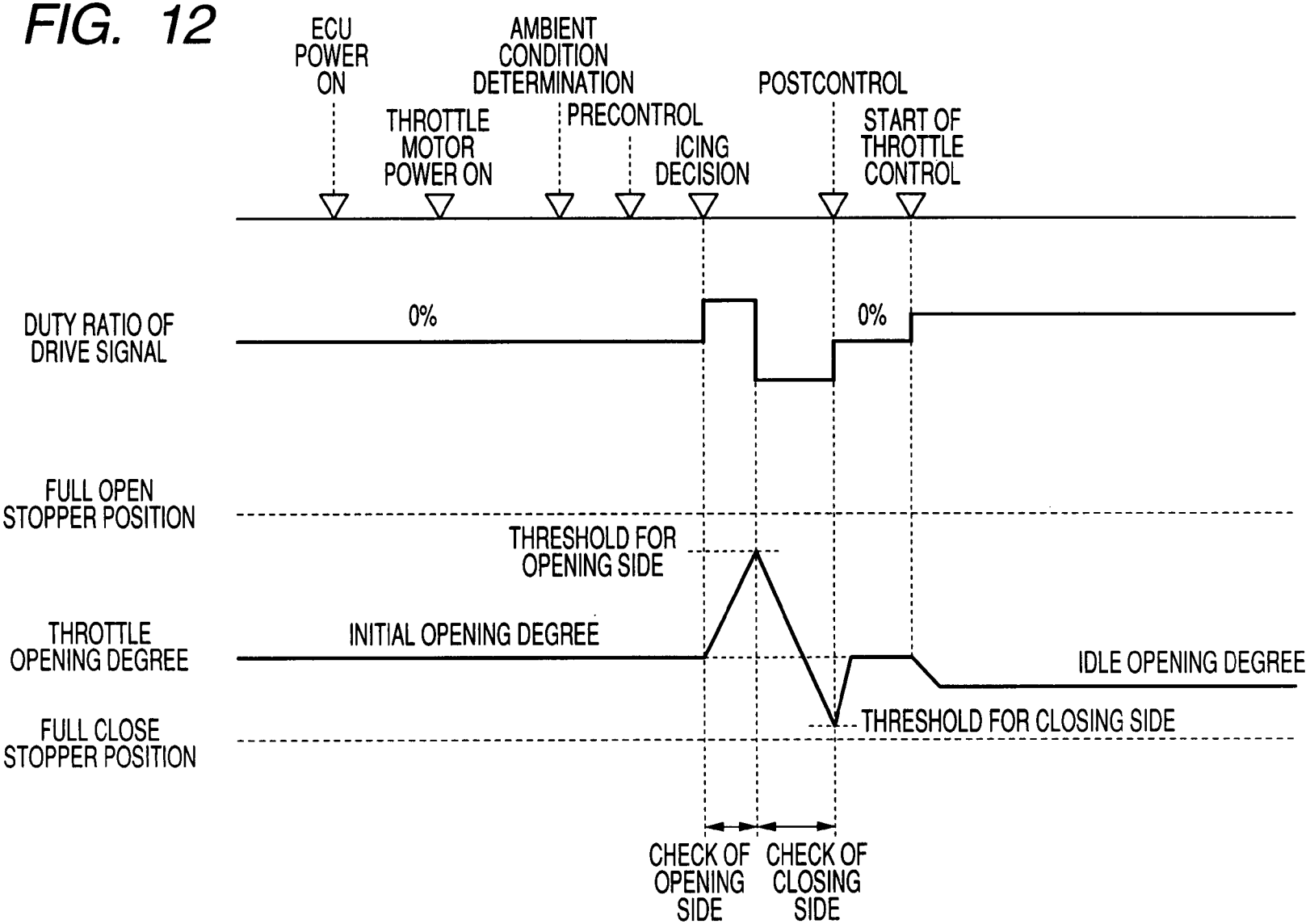
FIG. 12 is a diagram showing an example of temporal changes of the duty ratio of the drive signal and the throttle opening degree when a freeze decision process included in the freeze recovery control process is executed.

FIG. 12 is a diagram showing an example of temporal changes of the duty ratio of the drive signal and the throttle opening degree when the icing decision process P3 is executed, in a case where there is no icing on either of the opening side or the closing side of the throttle valve 12.

As shown in FIG. 12, at the beginning, the throttle valve 12 is driven in the opening direction to move from the initial position by the application of the opening drive signal to the motor 14. At this time, the duty ratio of the opening drive signal is set at a relatively small value, because in the icing decision process P3, the throttle valve 12 is driven to check whether or not icing is present in the throttle valve 12, and not to remove any ice piece formed in the throttle valve 12, and accordingly it is not necessary for the motor 14 to generate a large torque at this time. In addition, by setting the duty ratio of the opening drive signal at a small value, it becomes possible to protect a drive mechanism of the throttle valve 12 and to reduce electric power consumption.

When the opening degree of the throttle valve 12 increases to a certain value corresponding to the icing-determination threshold for the opening side of the throttle valve 12, the application of the opening drive signal to the motor 14 is stopped while assuming that icing is not present on the opening side of the throttle valve 12. After that, a closing drive signal is applied to the motor 14 to drive the throttle valve 12 in the closing direction.

When the opening degree of the throttle valve 12 reduces to a certain value corresponding to an icing-determination threshold for the closing side, where the throttle valve 12 is at a position close to the throttle full close stopper 34, the application of the closing drive signal to the motor 14 is stopped while assuming that icing is not present on the closing side of the throttle valve 12. After it is confirmed that icing is not present on either the opening side or the closing side of the throttle valve 12, the normal throttle control P7 is performed.

In the icing decision process P3, the throttle valve 12 is driven within its movable range estimated from the full close stopper position and the full open stopper position such that the throttle valve 12 does not hit the full open stopper and the full close stopper to protect the drive mechanism of the throttle valve 12.

If it is determined in the icing decision process P3 that icing is present on at least one of the opening side and the closing side of the throttle valve 12, the main control process P4 which is explained below with reference to flowcharts of FIG. 6 to FIG. 9 is executed.

Figure 6:
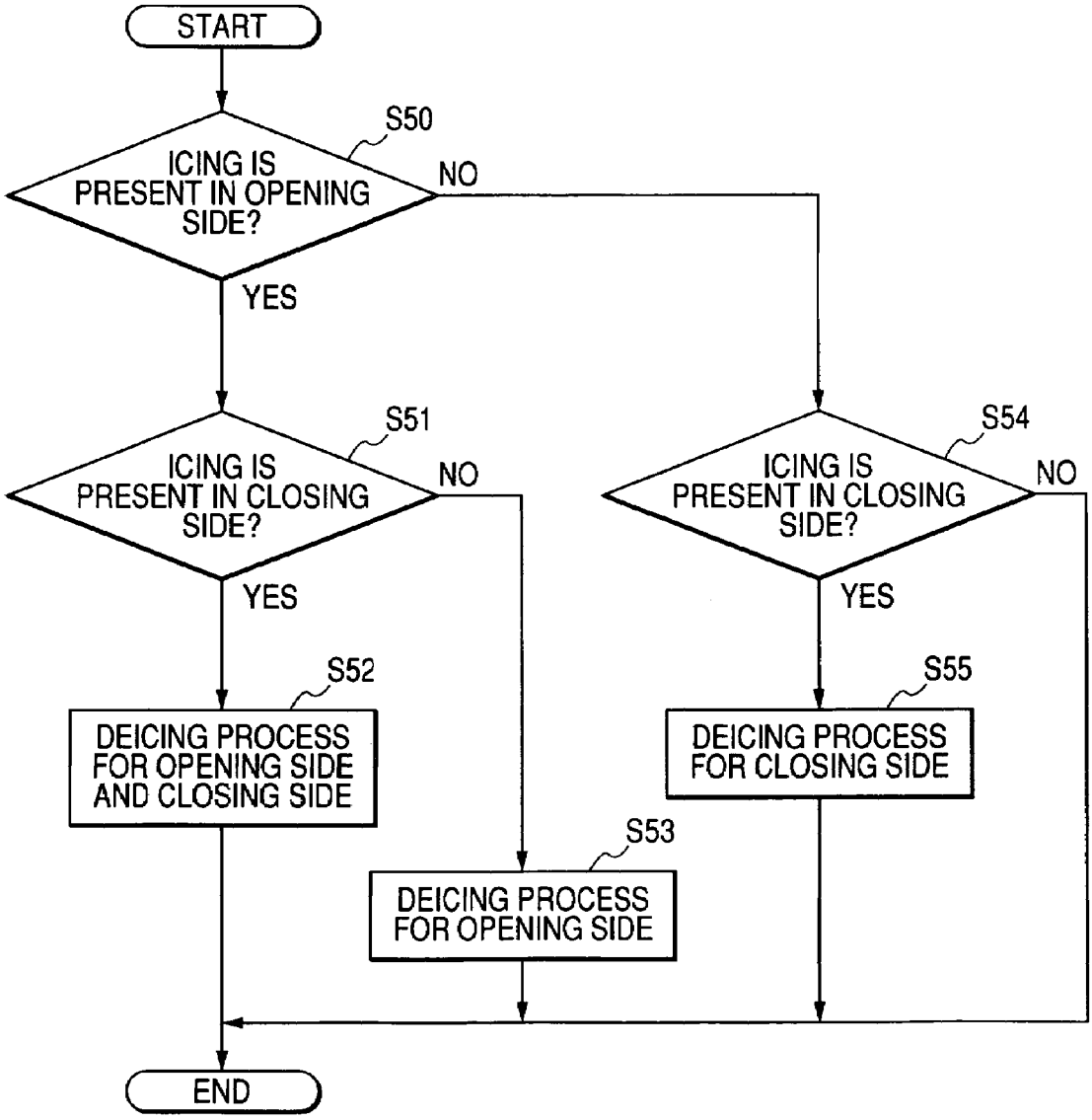
FIG. 6 is a flowchart showing contents of a main control process included in the freeze recovery control process.

As shown in FIG. 6, at the beginning, it is checked at step S50 whether or not icing has been determined to be present on the opening side of the throttle valve 12. If the check result at step S50 is affirmative, the process moves to step S51 where it is checked whether or not icing has been determined to be present on the closing side of the throttle valve 12.

Figure 7:
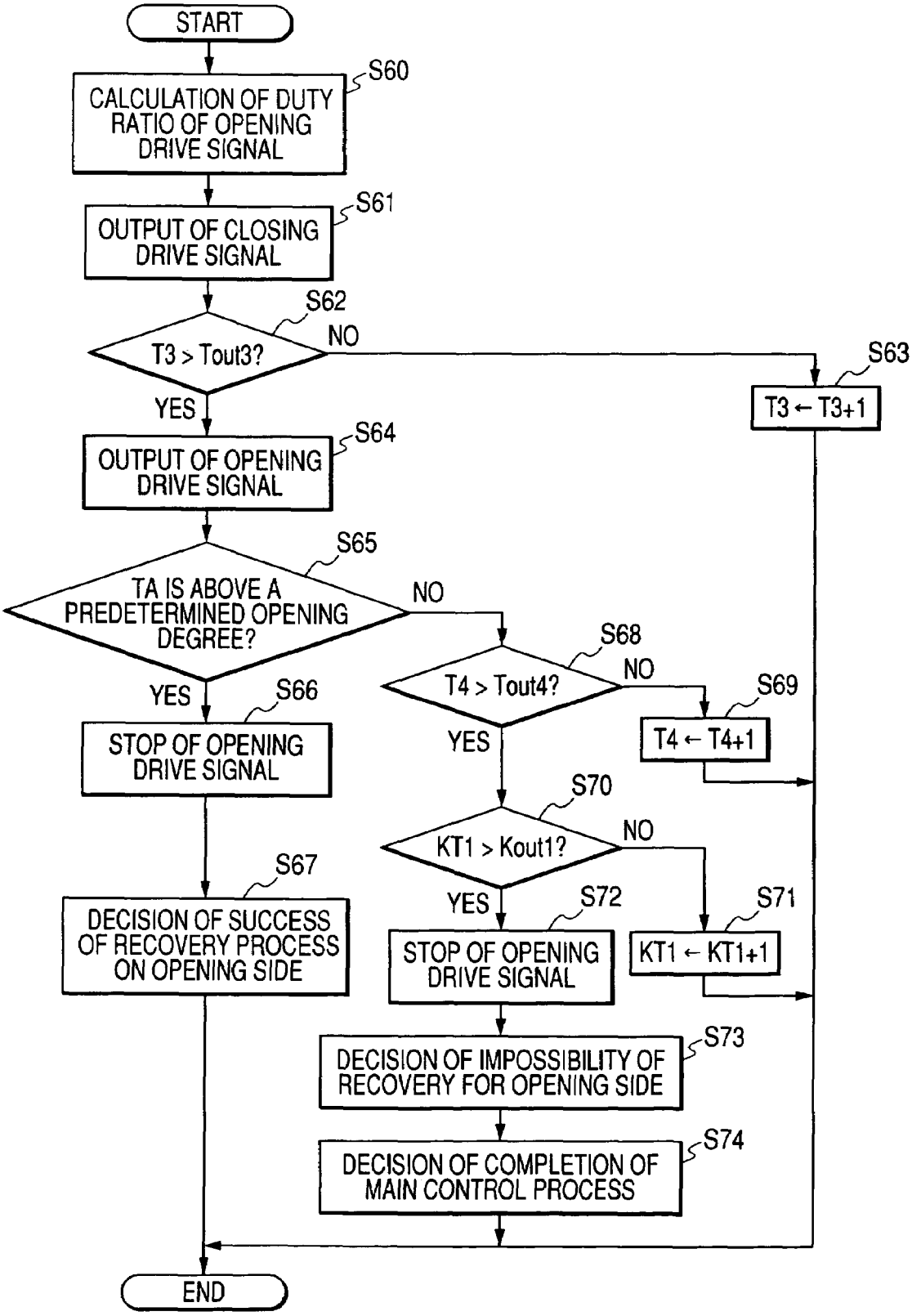
FIG. 7 is a flowchart showing contents of a deicing process for both of an opening side and a closing side of the throttle valve included in the main control process.

If the check result at step S51 is affirmative, since it means that there is an ice piece formed on both the opening side and the closing side of the throttle valve 12, the process moves to step S52 where a deicing process for both the opening side and the closing side which is explained later with reference to FIG. 7 is carried out on the throttle valve 12.

Figure 9:
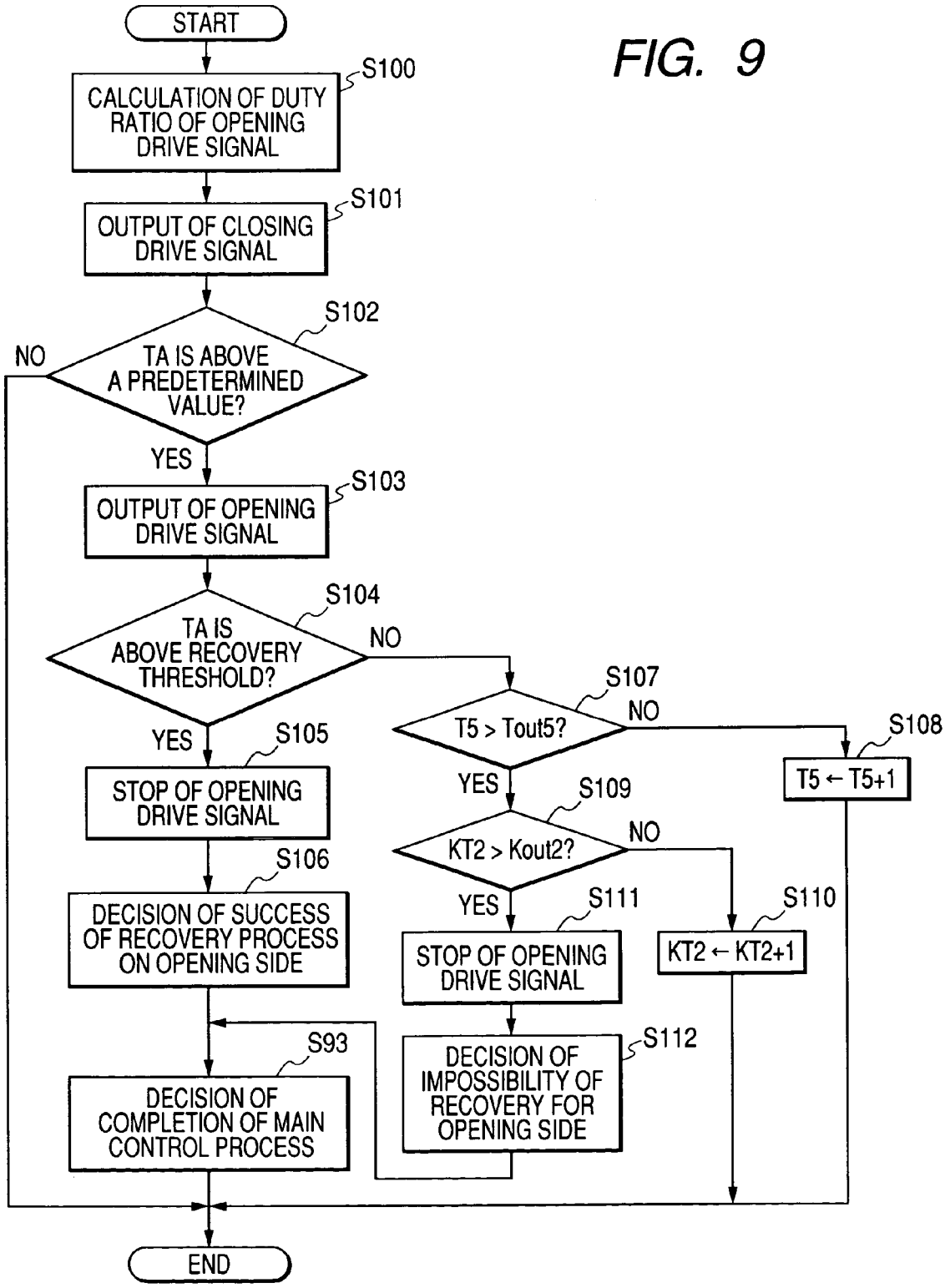
FIG. 9 is a flowchart showing contents of a deicing process for the opening side of the throttle valve included in the main control process.

On the other hand, if the check result at step S51 is negative, since it means that an ice piece is formed on only the opening side of the throttle valve 12, the process moves to step S53 where an deicing process for the opening side which is explained later with reference to FIG. 9 is carried out on the throttle valve 12.

Figure 8:
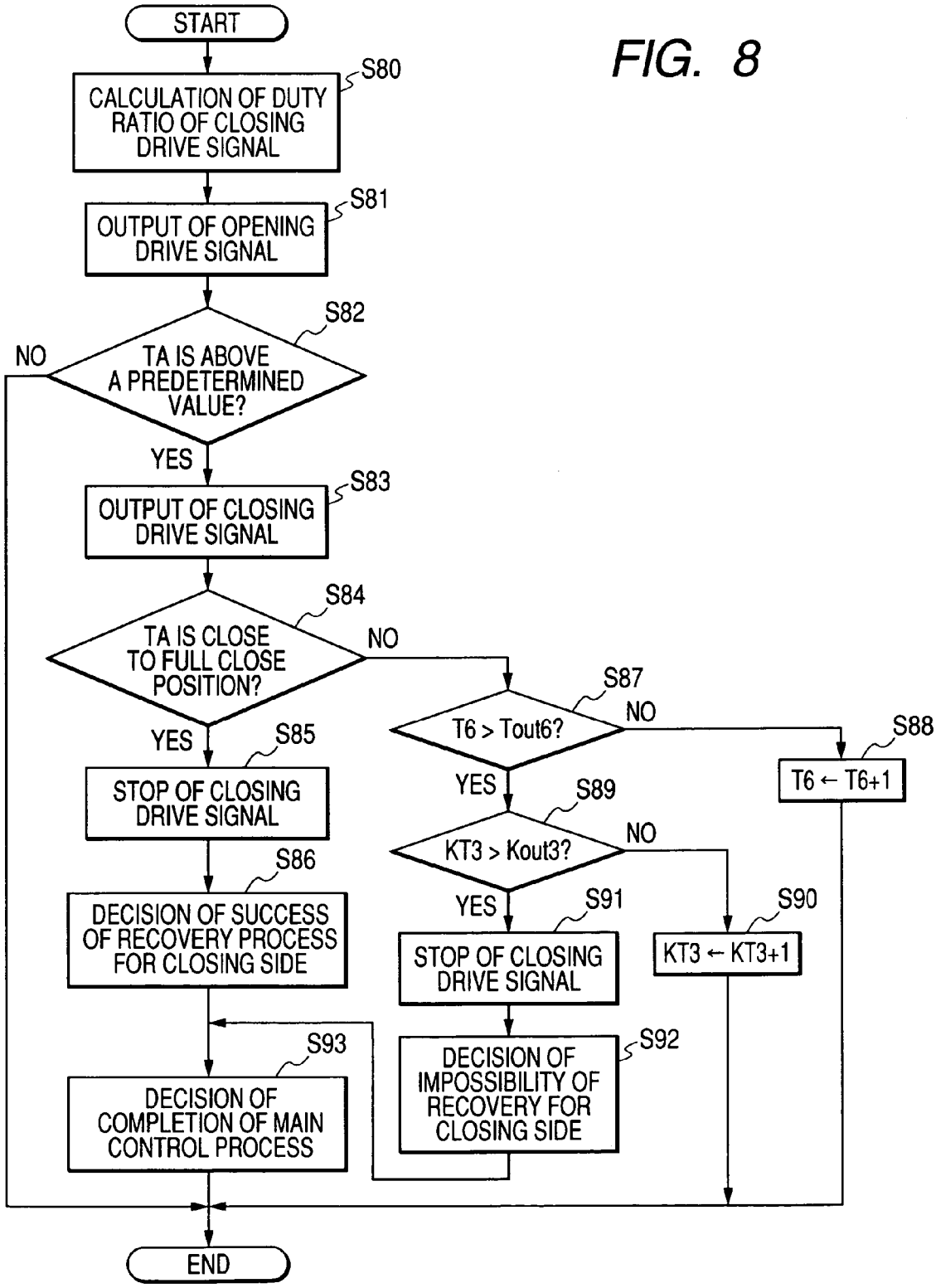
FIG. 8 is a flowchart showing contents of a deicing process for the closing side of the throttle valve included in the main control process.

If the check result at step S50 is negative, the process moves to step S54 where it is checked whether or not icing has been determined to be present on the closing side of the throttle valve 12. If the check result at step S54 is affirmative, since it means that icing is present on only the closing side of the throttle valve 12, the process moves to step S55 where a deicing process for the closing side which is explained later with reference to FIG. 8 is carried out on the throttle valve 12.

Next, the deicing process for both the opening side and the closing side is explained with reference to FIG. 7.

As shown in FIG. 7, this deicing process begins by calculating at step S60 the duty ratio of the opening drive signal applied to the motor 14 for driving the throttle valve 12 in the opening direction. At step S60, the duty ratio of the opening drive signal is calculated on the basis of a size of the formed ice piece that can be estimated from the opening side limit position memorized during execution of the icing decision process P3, and the full open stopper position. Since the torque generate by the motor 14 has to be increased with the increasing size of the formed ice piece, the duty ratio of the opening drive signal is determined depending on the estimated size of the formed ice piece.

The torque generate by the motor 14 varies depending on the value of the battery voltage even when the duty ratio of the opening drive signal is kept constant, and accordingly the determined duty ratio of the opening drive signal is corrected in accordance with the value of the battery voltage, so that the motor 14 can generate a target torque irrespective of variation of the battery voltage. The period of the opening drive signal may be corrected instead of correcting the duty cycle of the opening drive signal for the motor 14 to generate a target torque irrespective of variation of the battery voltage.

At subsequent step S61, the closing drive signal is applied to the motor 14 to drive the throttle valve 12 in the closing direction. This is done for the motor 14 to rotate in the reverse direction at least by an amount of gear clearance (play) in the speed reduction device 13. The motor 14 can rotate by the amount of gear clearance without driving the valve lever 30 and the throttle valve 12. Accordingly, it is not necessary to take care about the duty ratio of the closing drive signal because the throttle valve 12 may not be moved at this time. However, it is a matter of course that the duty ratio of the closing drive signal may be determined depending on the estimated size of the formed ice piece and the battery voltage.

At step S62, it is checked whether or not a count value of a counter T3 is larger than a predetermined value Tout3 to check whether or not the motor 14 has rotated in the reverse direction at least by the amount of the gear clearance.

If the check result at step S62 is negative, the count value of the counter T3 is incremented by one at step S63. And then, the process is temporarily ended, and after an elapse of a predetermined time, this deicing process is executed again. If the check result at step S62 is affirmative, the process moves to step S64 where the opening drive signal having the duty ratio calculated at step S60 is applied to the motor 14.

As explained above, in a case where an ice piece has been formed on both the opening side and the closing side of the throttle valve 12, the motor 14 is controlled to rotate in the reverse direction (the closing direction) first by the amount of the gear clearance, and then to rotate in the forward direction (the opening direction). This makes it possible for the motor 14 to build up speed at least for the time period during which the motor 14 rotates in the opening direction by the amount of the gear clearance. Accordingly, it becomes possible for the motor 14 to apply a large drive force in the opening direction to the throttle valve 12. Hence, the electronic throttle control apparatus of this embodiment offers a good recoverability from the frozen state on the opening side of the throttle valve 12.

Usually, the chance where the formed ice piece is bitten between the throttle valve 12 and the air inlet pipe 11 when the throttle valve 12 is driven in the opening direction is less than that when the throttle valve 12 is driven in the closing direction. Accordingly, in a case where an ice piece has been formed on both the opening side and the closing side of the throttle valve 12, it is preferable to drive the throttle valve 12 in the closing direction first by the amount of the gear clearance, and then in the opening direction in view of offering a good recoverability from the frozen state on both the opening side and the closing side of the throttle valve 12.

It should be noted that the motor 14 is controlled at step S64 to generate a torque such that the throttle valve 12 is driven within a predetermined driven range within which the throttle valve 12 does not hit the full open stopper.

At step S65, it is checked whether or not the throttle opening degree detection signal TA becomes larger than a predetermined recovery threshold to check whether or not the throttle valve 12 has recovered from the frozen state of the opening side thereof.

If the check result at step S65 is affirmative, since it means that the ice piece formed on the opening side of the throttle valve 12 has been removed, the application of the valve opening drive signal to the motor 14 is stopped at step S66, and then the fact that the throttle vale 12 has been recovered from the frozen state of the opening side thereof is memorized at step S67. Thereafter, the deicing process for the closing side of the throttle valve 12 shown in FIG. 8 is executed.

On the other hand, if the check result at step S65 is negative, the process moves to step S68 where it is checked whether or not a count value of a counter T4 is larger than a predetermined value Tout4. If the check result at step S68 is negative, the count value of the counter T4 is incremented by one at step S69. And then, the process is temporarily ended, and after an elapse of a predetermined time, this deicing process is executed again.

Accordingly, steps S64, S65, S68, and S69 continue to be executed in order to check whether or not the throttle opening degree detection signal TA representing the opening degree of the throttle valve 12 has exceeded the recovery threshold as long as a time equivalent to Tout4 does not elapse.

If the check result at step S68 is affirmative, since it means that the time defined by the value Tout4 has elapsed before the value of the throttle opening degree detection signal TA exceeds the recovery threshold for the opening side of the throttle valve 12, the process moves to step S70 after resetting the counter T4 while assuming that the deicing procedure has ended in failure. At step S70, it is checked whether or not a count value of a counter KT1 counting the number of times that the deicing procedure on the opening side of the throttle valve 12 has been carried out is larger than a predetermined value Kout1. If the check result at step S70 is negative, the process moves to step S71 where the count value of the counter KT1 is incremented by one. And then, the process is temporarily ended, and after an elapse of a predetermined time, this deicing process is executed again.

By the provision of the counter KT1, it becomes possible to repeat the deicing procedure on the opening side of the throttle valve 12 as many times as required.

If the check result at step S70 is affirmative, the process moves to step S72 to stop the application of the opening drive signal to the motor 14, so that the state where the engine 10 is prohibited from starting and the vehicle is prohibited from traveling can be prevented from lasting long, and that the drive mechanism of the throttle valve 12 can be prevented from being applied with an excessive load.

At step S73, the fact that it is impossible for the throttle valve 12 to recover from the frozen state of the opening side thereof is memorized, and at subsequent step S 74, the fact that the main control process P4 has been completed is memorized.

Next, the deicing process for the closing side of the throttle valve 12 is explained with reference to the flow chart of FIG. 8. This process is executed when an ice piece has been formed only on the closing side of the throttle valve 12. This process is also executed when an ice piece is formed on both the opening side and the closing side of the throttle valve 12, and the deicing process for the opening side shown in FIG. 7 has ended in failure.

As shown in FIG. 8, the deicing process for the closing side begins by calculating the duty ratio of the closing drive signal applied to the motor 14 for driving the throttle valve 12 in the closing direction. This calculation of the duty ratio is performed on the basis of the battery voltage and the size of the formed ice piece that can be estimated from the closing side limit position, and the full close stopper position just like the case of the above described deicing process for the opening side.

At subsequent step S81, the opening drive signal is applied to the motor 14 to drive the throttle valve 12 in the opening direction. However, when the deicing process shown in FIG. 8 is executed just after the execution of the deicing process shown in FIG. 7, this step is omitted. The duty ratio of the opening drive signal applied to the motor 14 at this time may be determined depending on the estimated size of the ice piece formed on the opening side of the throttle valve 12 and the battery voltage.

At step S82, it is checked whether or not the throttle opening degree detection signal TA is larger than a predetermined value in order to check whether or not the motor 14 can accelerate the throttle valve 12 in the closing direction. If the check result at step S82 is affirmative, and therefore the opening degree of the throttle valve 12 is determined to be large enough for the motor 14 driving the throttle valve 12 in the closing direction to build up sufficient speed, the process moves to step S83. Otherwise, the process is temporarily ended, and after an elapse of a predetermined time, this deicing process is executed again.

At step S83, the closing drive signal having the duty ratio calculated at step S80 is applied to the motor 14 to drive the throttle valve 12 in the closing direction. As explained above, since the throttle valve 12 is driven in the closing direction after it is driven in the opening direction, the throttle valve 12 can hit the ice piece formed on the closing side thereof at a speed high enough to remove the ice piece.

It should be noted that the motor 14 is controlled at step S83 to generate a torque such that the throttle valve 12 is driven within a predetermined driven range within which the throttle valve 12 does not hit the full close stopper.

At step S84, it is checked whether or not the throttle opening degree detection signal TA has reached a predetermined recovery threshold in order to check whether the throttle valve 12 has recovered from the frozen state of the closing side thereof.

If the check result at step S 84 is affirmative, since it means that the ice piece formed on the closing side of the throttle valve 12 has been removed, the application of the closing drive signal to the motor 14 is stopped at step S85, and then the fact that the throttle valve 12 has recovered from the frozen state of the closing side thereof is memorized at step S86.

On the other hand, if the check result at step S84 is negative, the process moves to step S87 where it is checked whether or not a count value of a counter T6 is larger than a predetermined value Tout6, while assuming that the opening degree of the throttle valve 12 has not reached the value corresponding to the recovery threshold for the closing side thereof. At subsequent step S87, it is checked whether or not a count value of a counter T6 is larger than a predetermined value Tout6. If the check result at step S87 is negative, the process moves to step S88 where the counter T6 is reset. And then, the process is temporarily ended, and after an elapse of a predetermined time, this deicing process is executed again.

Accordingly, steps S83, S84, S87, and S88 continue to be executed in order to check whether or not the value of the throttle opening degree detection signal TA representing the opening degree of the throttle valve 12 has exceeded the recovery threshold for the closing side as long as a time equivalent to Tout6 does not elapse.

If the check result at step S87 is affirmative, since it means that the time defined by the value Tout6 has elapsed before the value of the throttle opening degree detection signal TA exceeds the recovery threshold for the closing side, the process moves to step S89 after resetting the counter T6 while assuming that the deicing procedure for the valve closing side of the throttle valve 12 has ended in failure. At step S89, it is checked whether or not a count value of a counter KT3 counting the number of times that the deicing procedure on the valve closing side has been carried out is larger than a predetermined value Kout3. If the check result at step S89 is negative, the process moves to step S90 where the count value of the counter KT3 is incremented by one. And then, the process is temporarily ended, and after an elapse of a predetermined time, this deicing process is executed again.

By the provision of the counter KT3, it becomes possible to repeat the deicing procedure for the valve closing side of the throttle valve 12 as many times as required.

If the check result at step S89 is affirmative, the process moves to step S91 to stop the application of the closing drive signal to the motor 14. At subsequent step S92, the fact that it is impossible for the throttle valve 12 to recover from the frozen state of the closing side thereof is memorized.

If it is determined that the throttle valve 12 has recovered from the frozen state of the closing side thereof at step S86, or it is determined that it is impossible for the throttle valve 12 to recover from the frozen state of the closing side thereof at step S92, the process moves to step S93 where the fact that that the main control process P4 has been completed is memorized.

Figure 13:
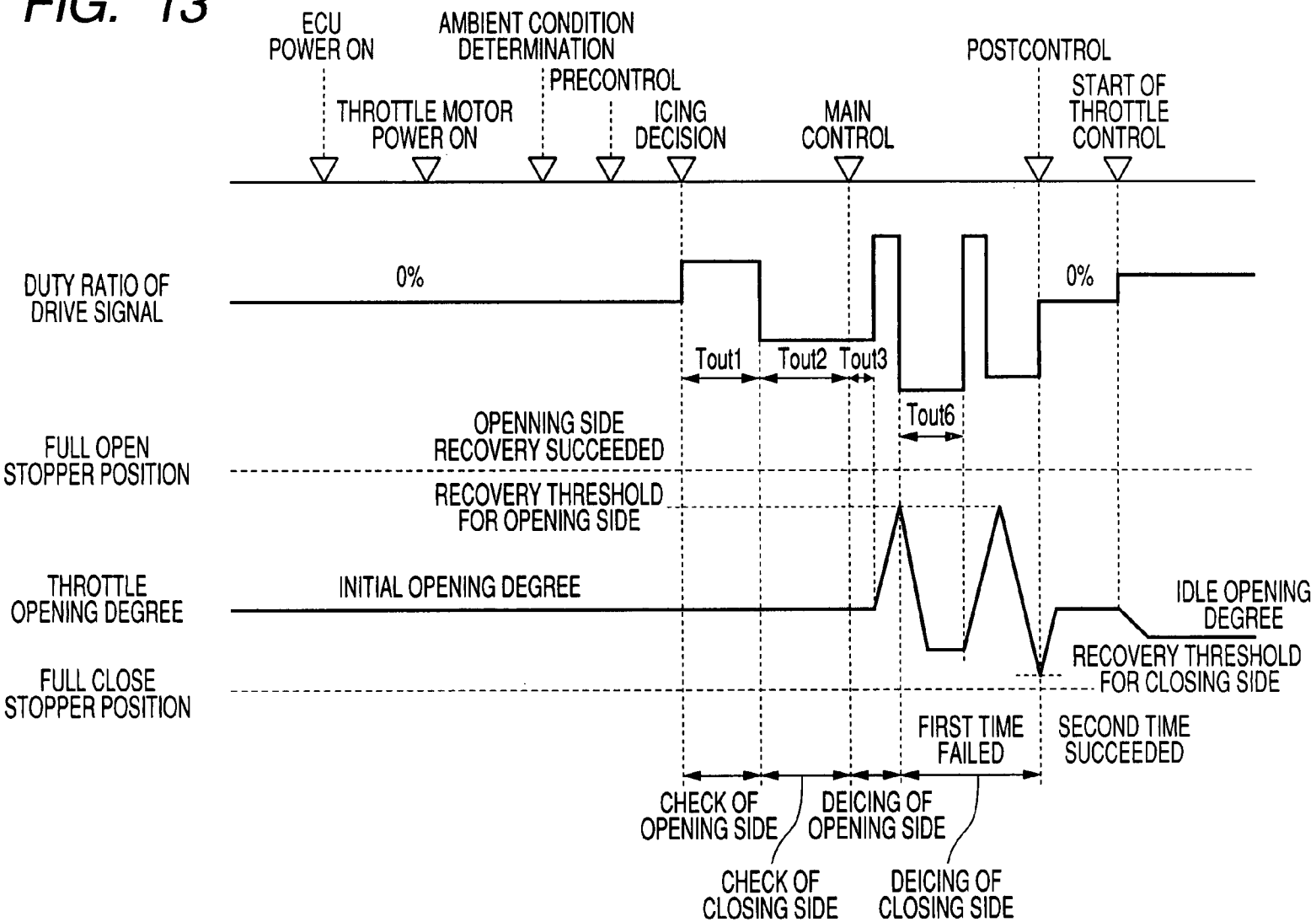
FIG. 13 is a diagram showing an example of temporal changes of the duty ratio of the drive signal and the throttle opening degree when the deicing process for both the opening side and the closing side of the throttle valve included in the freeze recovery control process is executed.

FIG. 13 is a diagram showing an example of temporal changes of the duty ratio of the drive signal and the throttle opening degree when the deicing process for both the opening side and the closing side of the throttle valve 12 is executed, in a case where the throttle valve 12 can recover from the frozen state of the opening side thereof in the first time throttle valve driving operation, and can recover from the frozen state of the closing side thereof in the second time throttle valve driving operation.

As shown in FIG. 13, in the deicing process for both the opening side and the closing side, the motor 14 is applied with the closing drive signal for a time period corresponding to Tout3, so that the motor 14 rotates in the reverse direction at least by the amount of the gear clearance in the speed reduction device 13 before the motor 14 rotates in the forward direction. This makes it possible for the motor 14 to build up speed high enough to apply a large drive force in the opening direction to the throttle valve 12. Thus, an ice piece formed on the opening side of the throttle valve 12 is removed in the first time throttle valve driving operation.

When the opening degree of the throttle valve 12 reaches a value corresponding to the recovery threshold for the opening side, the application of the opening drive signal to the motor 14 is stopped, while assuming that the throttle valve 12 has recovered from the frozen state of the opening side thereof. Subsequently, the process shown in FIG. 8 is executed, as a result of which the motor 14 is applied with the closing drive signal to drive the throttle valve 12 in the closing direction, to thereby remove an ice piece formed on the closing side of the throttle valve 12.

As already explained above, the throttle valve 12 is accelerated sufficiently before hitting the ice piece formed on the closing side of the throttle valve 12 so that the ice piece can be given a large impact.

It should be noted that, also in the above deicing process, the throttle valve 12 is driven within a predetermined driven range within which the throttle valve 12 does not hit the full open stopper and the full close stopper.

Figure 14:
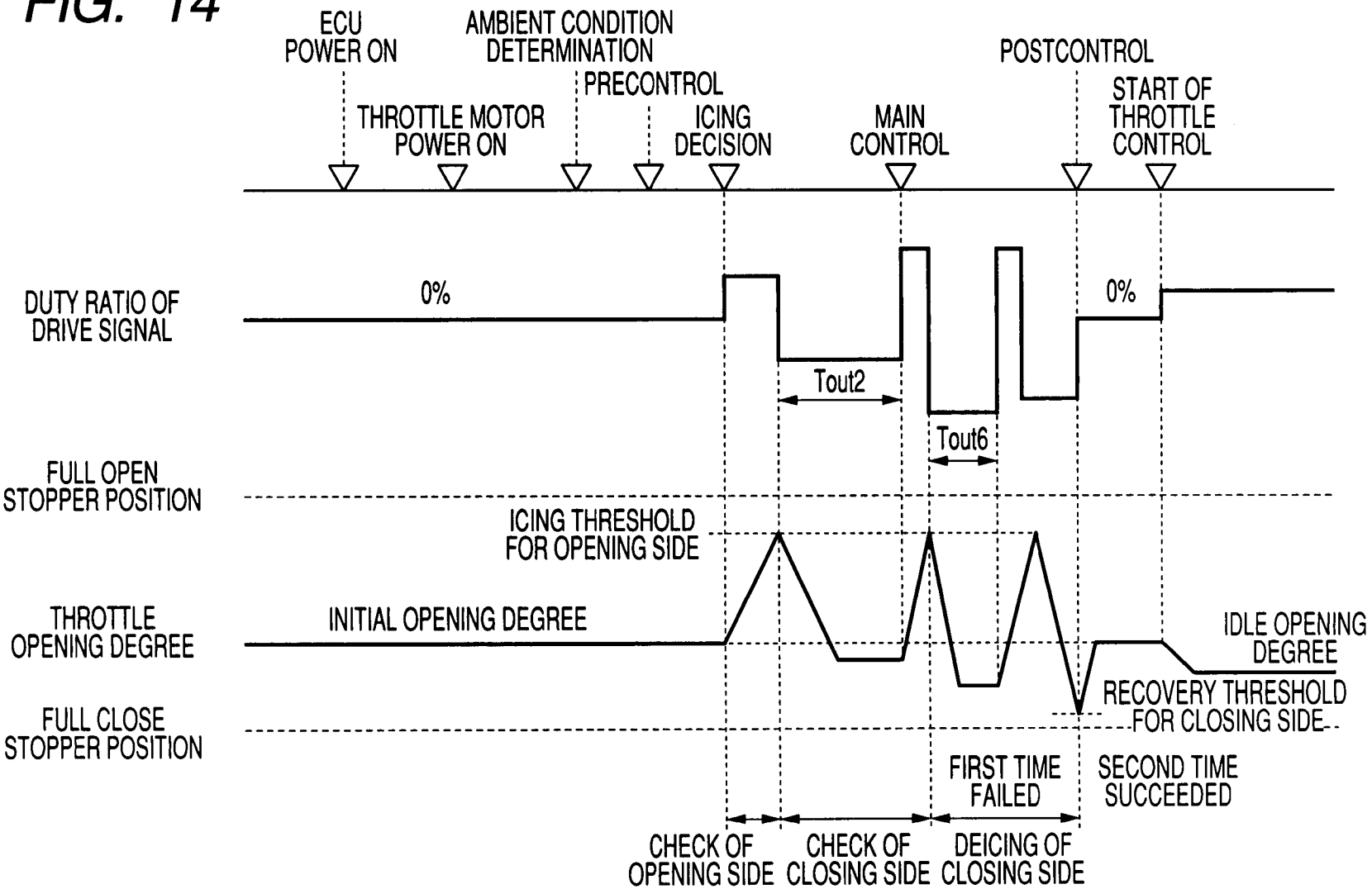
FIG. 14 is a diagram showing an example of temporal changes of the duty ratio of the drive signal and the throttle opening degree when the deicing process for the closing side of the throttle valve included in the freeze recovery control process is executed.

FIG. 14 is a diagram showing an example of temporal changes of the duty ratio of the drive signal and the throttle opening degree when the deicing process for the closing side of the throttle valve 12 executed, in a case where the throttle valve 12 can recover from the frozen state of the closing side thereof in the second time throttle valve driving operation.

If it is determined that the opening degree of the throttle valve 12 has reached a value corresponding to the icing threshold for the opening side, but has not reached a value corresponding to the icing threshold for the closing side, it can be estimated that an ice piece has formed only on the closing side of the throttle valve 12. In this case, the deicing process for the closing side shown in FIG. 8 is executed.

The deicing process for the closing side begins by driving the throttle valve 12 to the opening side thereof where no ice piece is formed so that the throttle valve 12 reaches a position from which the throttle valve 12 can build up sufficiently high speed before hitting the ice piece formed on the closing side when it is driven to the closing side. When the ice piece formed on the closing side is removed, and as a result the opening degree of the throttle valve 12 reaches the value corresponding to the recovery threshold, it is determined that the deicing process has ended in success.

Next, the deicing process for the opening side is explained with reference to the flowchart of FIG. 9. This process is executed when an ice piece is formed only on the opening side of the throttle valve 12.

As shown in FIG. 9, this deicing process begins by calculating the duty ratio of the opening drive signal applied to the motor 14 for driving the throttle valve 12 in the opening direction at step S100. This calculation of the duty ratio is performed on the basis of the size of the formed ice piece that can be estimated from the full open stopper position and the opening side limit position.

At subsequent step S101, the closing drive signal is applied to the motor 14 to drive the throttle valve 12 in the closing direction. The duty ratio of the closing drive signal applied to the motor 14 at this time may be determined depending on the battery voltage.

At step S102, it is checked whether or not the throttle opening degree detection signal TA has reached a predetermined value in order to check whether or not the motor 14 can accelerate the throttle valve 12 in the opening direction. If the check result at step S102 is affirmative, and therefore the throttle opening degree detection signal TA is determined to have reached the predetermined value, the process moves to step S103. Otherwise, the process is temporarily ended, and after an elapse of a predetermined time, this deicing process is executed again.

At step S103, the opening drive signal having the duty ratio calculated at step S100 is applied to the motor 14 to drive the throttle valve 12 in the opening direction. As explained above, since the throttle valve 12 is driven in the opening direction after it is driven in the closing direction, the throttle valve 12 can hit the ice piece formed on the opening side thereof at a speed high enough to remove the ice piece.

It should be noted that the motor 14 is controlled at step S103 to generate a torque such that the throttle valve 12 is driven within a predetermined driven range within which the throttle valve 12 does not hit the full open stopper.

At step S104, it is checked whether or not the throttle opening degree detection signal TA has reached a predetermined recovery threshold in order to check whether the throttle valve 12 has recovered from the frozen state of the opening side thereof.

If the check result at step S104 is affirmative, since it means that the ice piece formed on the opening side of the throttle valve 12 has been removed, the application of the valve opening drive signal to the motor 14 is stopped at step S105, and then the fact that the throttle valve 12 has recovered from the frozen state of the opening side thereof is memorized at step S106.

On the other hand, if the check result at step S104 is negative, the process moves to step S107 where it is checked whether or not a count value of a counter T5 is larger than a predetermined value Tout5, while assuming that the opening degree of the throttle valve 12 has not reached the value corresponding to the recovery threshold for the opening side thereof. If the check result at step S107 is negative, the count value of the counter T5 is incremented by one at step S108. And then, the process is temporarily ended, and after an elapse of a predetermined time, this deicing process is executed again.

Accordingly, steps S103, S104, S107, and S108 continue to be executed to check whether or not the opening degree of the throttle valve 12 represented by the throttle opening degree detection signal TA has exceeded the recovery threshold for the opening side as long as a time equivalent to Tout5 does not elapse.

If the check result at step S107 is affirmative, it means that the time defined by the value Tout5 has elapsed before the value of the throttle opening degree detection signal TA exceeds the recovery threshold for the opening side. In this case, the process moves to step S109 after resetting the counter T5 while assuming that the deicing procedure for the opening side of the throttle valve 12 has ended in failure. At step S109, it is checked whether or not a count value of a counter KT2 counting the number of times that the deicing procedure on the opening side has been carried out is larger than a predetermined value Kout2. If the check result at step S109 is negative, the process moves to step S110 where the count value of the counter KT2 is incremented by one. And then, the process is temporarily ended, and after an elapse of a predetermined time, this deicing process is executed again.

By the provision of the counter KT2, it becomes possible to repeat the deicing procedure for the valve opening side of the throttle valve 12 as many times as required.

If the check result at step S109 is affirmative, the process moves to step S11*l* to stop the application of the opening drive signal to the motor 14. At subsequent step S112, the fact that it is impossible for the throttle valve 12 to recover from the frozen state of the opening side thereof is memorized.

If it is determined that the throttle valve 12 has recovered from the frozen state of the valve opening side thereof at step S106, or it is determined that it is impossible for the throttle valve 12 to recover from the frozen state of the opening side thereof, the process moves to step S113 where the fact that that the main control process P4 has been completed is memorized.

Figure 15:
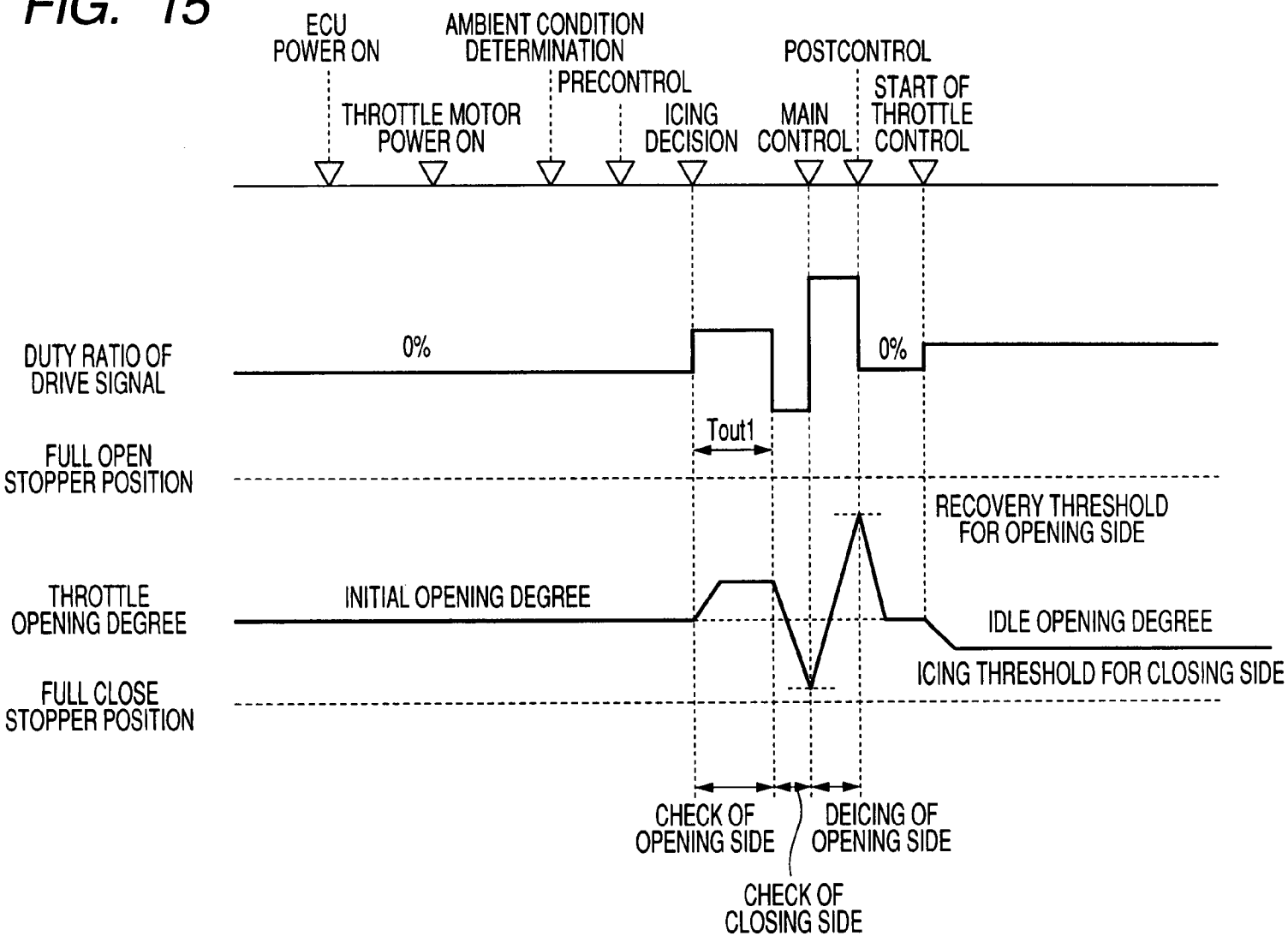
FIG. 15 is a diagram showing an example of temporal changes of the duty ratio of the drive signal and the throttle opening degree when the deicing process for the closing side of the throttle valve included in the freeze recovery control process is executed.

FIG. 15 is a diagram showing an example of temporal changes of the duty ratio of the drive signal and the throttle opening degree when the deicing process for the opening side of the throttle valve 12 executed, in a case where the throttle valve 12 can recover from the frozen state of the opening side thereof in the first time throttle valve driving operation.

If it is determined that the opening degree of the throttle valve 12 has not reached the value corresponding to the icing threshold for the valve opening side, but has reached the value corresponding to the icing threshold for the valve closing side, it can be estimated that an ice piece has formed only on the opening side of the throttle valve 12. In this case, the deicing procedure for the opening side shown in FIG. 9 is executed.

The deicing process for the opening side begins by driving the throttle valve 12 to the closing side where no ice piece is formed so that the throttle valve 12 reaches a position from which the throttle valve 12 can build up sufficiently high speed before hitting the ice piece formed on the opening side when it is driven to the opening side. Incidentally, in a case where the main control process P4 is executed following the execution of the icing decision process P3, the throttle valve driving operation in the icing decision process P3 may be doubled as that of step S101 the main control process P4.

After that, the throttle valve 12 is driven in the opening direction to hit the ice piece formed on the opening side of the throttle valve 12. When the ice piece formed on the opening side is removed, and as a result the opening degree of the throttle valve 12 reaches the value corresponding to the recovery threshold, it is determined that the deicing process has ended in success.

Figure 10:
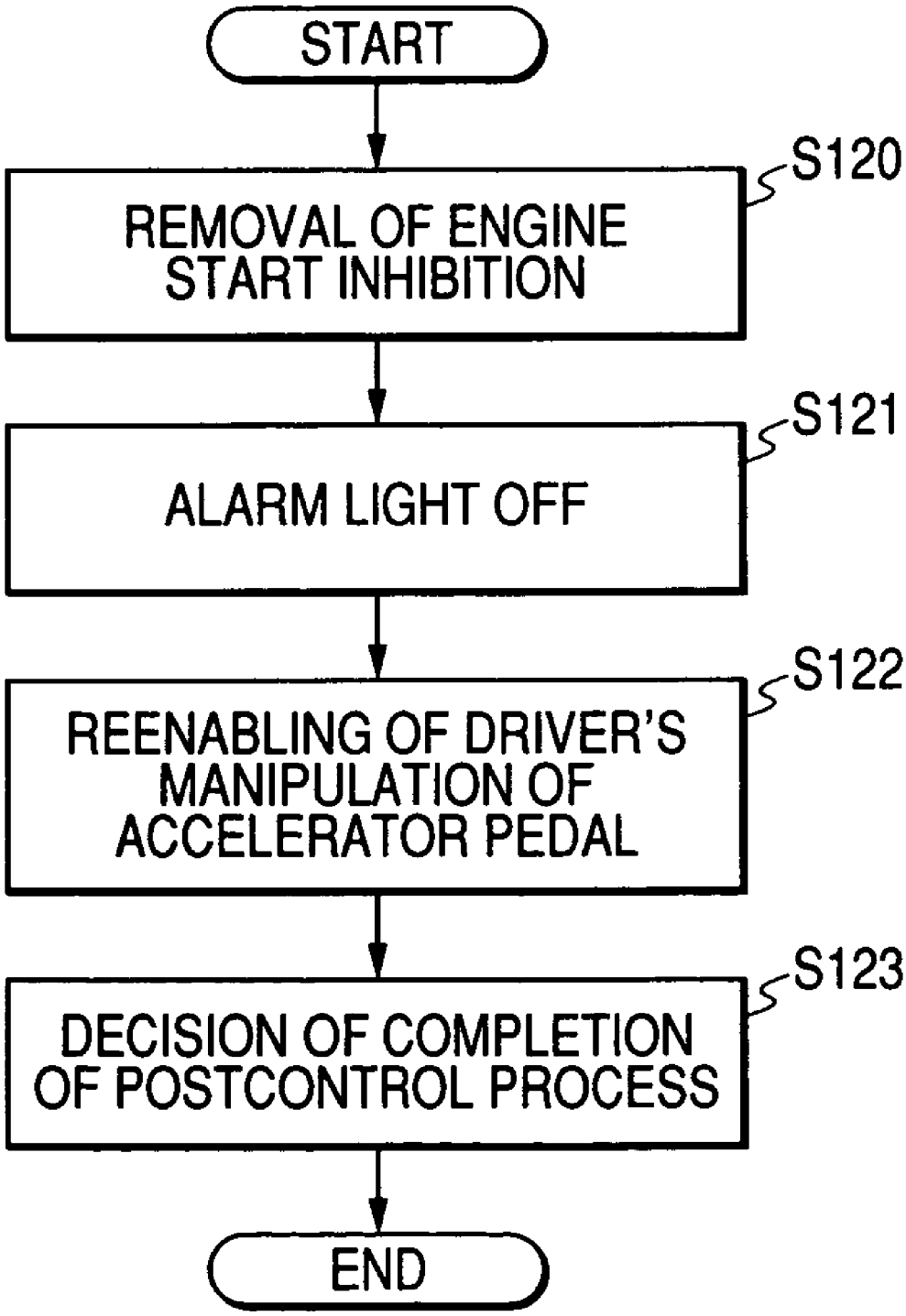
FIG. 10 is a flowchart showing contents of a post control process included in the freeze recovery control process.

When the main control process P4 is completed, the postcontrol process P5 is executed. FIG. 10 is a flowchart showing detailed contents of the postcontrol process P5. As shown in FIG. 10, the postcontrol process begins by removing the engine start inhibition. If the clutch mechanism or brake mechanism has been set to a state of keeping the vehicle parked, they are reset to a normal state.

After that, the first alarm light 21 which has been in the on state to notify the vehicle passengers that the engine 10 is inhibited from being started is put off. As a result the vehicle passengers can know that the vehicle has recovered to a state where it can travel.

Preferably, the electronic throttle control apparatus of this embodiment is provided with a speaker device to enable instructing by voice the passengers to start the engine 10.

At subsequent step S122, the driver's demand on the throttle valve opening degree, that is, the driver's manipulation of the accelerator pedal is reenabled.

At step S123, the fact that the postcontrol process P5 has been completed is memorized by use of a flag, or the like.

After execution of the postcontrol process P5, the fail-safe process P6, or the normal throttle control process P7 is performed depending on the result of the execution of the icing decision process P3 and the result of the execution of the main control process P4. More specifically, if the deicing process of the main control process P4 has been ended in failure, the fail-safe process P6 is performed, and otherwise, the normal throttle control process P7 is performed.

In the fail-safe process P6, the output torque of the engine 10 is controlled by varying at least one of ignition timing, fuel injection timing, fuel injection amount, open/close timing of inlet valves, and open/close timing of exhaust valves. It is because, when the throttle valve 12 cannot recover from the frozen state, the movement of the throttle valve 12 is limited. When the fail-safe control P6 is performed, the alarm light 22 is put on to notify the vehicle passages that the engine 10 is under the fail-safe control, because the behavior of the engine 10 in the fail-safe control is different from that in the normal throttle control P7.

In the fail-safe control P6, power supply to the motor 14 is interrupted, and the engine 10 is controlled to make up for output torque surplus or insufficiency due to inactivity of the throttle valve 12 which is fixed at the initial position. This enables at least evacuation drive while avoiding the motor 14 from consuming electric power.

If the throttle valve 12 is movable within a limited part of the movable range between the full open position and the full close position, the throttle valve 12 may be driven within this limited part in the fail-safe control P6. In this case, when a target opening degree of the throttle valve 12 is outside the limited part of the movable range, the engine 10 is fail-safe controlled such that insufficiency or surplus of the output power due to the limited activity of the throttle valve 12 is made up, so that the engine 10 can generate a torque close to a target torque. In this case, it can be expected that ice pieces formed on the throttle valve 12 melt by heat conduction from the motor 14 operating to drive the throttle valve 12 to the throttle valve 12.

Incidentally, when a target opening degree of the throttle valve 12 is outside the limited part of the movable range, it is preferable to hold the throttle valve 12 at an upper limit or lower limit of the limited part during the fail-safe control, so that the engine 10 can generate a torque as close to a target torque as possible.

In the case where the throttle valve 12 is held at the upper limit position of the limited part of the movable range, it is preferable to set the duty ratio of the drive signal as small as possible as far as the throttle valve 12 can be held at the upper limit position, so that the electric power consumed by the motor 14 operating to hold the throttle valve 12 at the upper limit position of the limited part of the movable range can be suppressed, and the drive circuit 15 of the motor 14 can be protected from over current.

During the fail-safe control P6, the motor 14 may be supplied with the drive signal even when the throttle valve 12 is not movable, since there is a possibility that the formed ice piece melts by the heat emitted from the motor 14. If the ice piece remains on the closing side of the throttle valve 12 despite the execution of the deicing process, there occurs a possibility that the volume of inlet air becomes insufficient, and the engine 10 stalls even when the throttle valve 12 is controlled at an idle speed position.

Accordingly, in a case where output torque of the engine 10 cannot be maintained as high as a target engine torque during execution of the fail-safe control P6, the position of the throttle valve 12 may be shifted in the opening direction if the throttle valve 12 is movable in the opening direction.

It goes without saying that many modifications can be made in the above described embodiment as described below.

Although the movable range of the throttle valve 12 is estimated from the full close stopper position and the full open stopper position in this embodiment, it may be defined on the basis of an actual full open position and an actual full close position which can be measured by driving the throttle valve 12 in the opening direction and the closing direction when the engine 10 is stopped.

A maximum limit of electric power supplied from the motor drive circuit 15 to the motor 14 during execution of the main control process P4 may be set larger than that during execution of the normal throttle control process P7, so that the recoverability from the frozen state of the throttle valve 12 is improved.

Setting the maximum limit of electric power supplied from the motor drive circuit 15 to the motor 14 can be implemented, for example, by providing the motor drive circuit 15 with a current limiter capable of limiting a maximum current supplied to the motor 14 that can be disabled during the execution of the main control process P4, or providing the motor drive circuit 15 with a voltage booster circuit that can be enabled during the execution of the main control process P4. At the time of setting the maximum limit of electric power at a high level, power supply to actuators necessary for starting the engine 10 (spark plugs, a fuel injection device, starter etc.) may be interrupted to increase the electric power suppliable to the motor 14.

In the icing decision process P3, and the main control process P4, presence of icing, and success and failure of the deicing process may be determined on the basis of whether or not an amount of change of the opening degree of the throttle valve 12 when it is driven in the closing direction or the opening direction by the motor 14 is larger than a predetermined value, instead of whether or not the opening degree of the throttle valve 12 when it is driven in the closing direction or the opening direction by the motor 14 reaches a predetermined value.

It is preferable to configure the electronic throttle control apparatus of this embodiment to shift a target opening degree of the throttle valve 12 in the opening direction under a low temperature environment, if an output torque of the engine 10 does not reach a target torque even when the opening degree of the throttle valve 12 is kept at a target opening degree by performing the normal throttle control. Because there can be a case where an ice piece is formed after starting the normal throttle control, and an air flow passage cross section of the air inlet pipe 11 is reduced accordingly.

The electronic throttle control apparatus of this embodiment may be provided with a nonvolatile memory (EEPROM, for example) for storing data about formation of ice pieces detected by the execution of the icing-decision process P3. The data stored in the nonvolatile memory, which can be read at an appropriate site, an automobile dealer, for example, can be used for failure analysis and design feedback information.

The data may include at least one of the number of times that formation of an ice piece was detected, the ambient temperature, movable range of the throttle valve 12 when formation of the ice piece was detected, the power supply voltage of the motor 14, success and failure of the freeze recovery control process, and the number of times that the throttle valve 12 was driven to recover from the frozen state.

The above explained preferred embodiments are exemplary of the invention of the present application which is described solely by the claims appended below. It should be understood that modifications of the preferred embodiments may be made as would occur to one of skill in the art.

What is claimed is:

1. An electronic throttle control apparatus for a vehicle engine comprising:

a throttle actuator including an electric motor generating torque for driving a throttle valve in an opening direction and a closing direction of said throttle valve through a transmission gear device;

a throttle opening degree sensor detecting an opening degree of said throttle valve; and a throttle control unit controlling said electric motor such that opening degree of said throttle valve detected by said throttle opening degree sensor becomes equal to a target throttle opening degree;

wherein said throttle control unit includes an icing decision function deciding whether or not said throttle valve is in a frozen state where icing is present in said throttle valve, and a deicing control function executing a freeze recovery process for recovering, wherein when said throttle valve is decided to be in said frozen state by said icing decision function, said throttle valve is controlled to make a forceful movement against the ice in an attempt to relieve the throttle valve from said frozen state in a single blow by controlling said electric motor;

(a) to drive said throttle valve in a first direction away from ice to be broken at least by an amount of a clearance of said transmission gear device, and then (b) drive and accelerate said throttle valve in the other direction toward the ice to be broken while accelerating the throttle valve.

2. The electronic throttle control apparatus according to claim 1, wherein said icing decision function is configured to decide whether or not icing is present for each of an opening side and an closing side of said throttle valve, and said deicing control function is configured to execute said freeze recovery process on each of said opening side and said closing side of said throttle valve.

3. The electronic throttle control apparatus according to claim 2, wherein, when said icing decision function decides that icing is present only in one of said opening side and said closing side, said deicing control function executes said freeze recovery process by controlling said electric motor to drive said throttle valve to one of said opening side and said closing side where no icing is present, and then to drive said throttle valve to the other of said opening side and said closing side where icing is present.

4. The electronic throttle control apparatus according to claim 2, wherein, when said icing decision function decides that icing is present in both said opening side and said closing side, said deicing control function executes said freeze recovery process by controlling said electric motor to drive said throttle valve to said closing side, and then to said opening side.

5. The electronic throttle control apparatus according to claim 2, wherein said icing decision function includes a first deciding function deciding whether or not there is a possibility that said throttle vale is in said frozen state on the basis of an ambient temperature of said throttle valve.

6. The electronic throttle control apparatus according to claim 5, wherein said first deciding function is configured to use, as said ambient temperature, at least one of a temperature of inlet air sucked to said vehicle engine and a temperature of a cooling water of said vehicle engine.

7. The electronic throttle control apparatus according to claim 5, wherein icing decision function includes a second deciding function making an icing decision to decide whether or not icing is present in said throttle valve for each of said opening side and said closing side of said throttle valve on the basis of values of opening degree of said throttle valve detected by said throttle opening degree sensor when said throttle valve is driven to said opening side and to said closing side, respectively, by said electric motor.

8. The electronic throttle control apparatus according to claim 7, wherein said second deciding function is configured to make said icing decision when said first deciding function decides that there is a possibility that said throttle vale is in said frozen state.

9. The electronic throttle control apparatus according to claim 7, wherein said second deciding function is configured to control said electric motor to generate a predetermined torque in order to drive said throttle valve to said opening side and to said closing side for making said icing decision.

10. The electronic throttle control apparatus according to claim 7, wherein said throttle valve is provided with a full open stopper and a full close stopper, said throttle valve being held at an initial position set between an opening side limit position and a closing side limit position defined by said full open stopper and said full close stopper when said electric motor is deenergized, and wherein said throttle control unit includes a movable range estimating function estimating, on the basis of said opening side limit position and said closing side limit position, a movable range of said throttle valve within which said throttle valve is movable without abutting against said full open stopper and said full close stopper, said second deciding function being configured to set a driven range in said movable range, and to control said electric motor to drive said throttle valve within said driven range at the time of driving said throttle valve to said opening side and to said closing side for making said icing decision.

11. The electronic throttle control apparatus according to claim 7, wherein said second deciding function is configured to decide that icing is present in one of said opening side and said closing side, if a value of opening degree of said throttle valve does not reach a predetermined value when said throttle valve is driven to corresponding one of said opening side and said closing side for making said icing decision.

12. The electronic throttle control apparatus according to claim 7, wherein said second deciding function is configured to decide that icing is present in one of said opening side and said closing side, if an amount of change of opening degree of said throttle valve does not reach a predetermined value when said throttle valve is driven to corresponding one of said opening side and said closing side for making said icing decision.

13. The electronic throttle control apparatus according to claim 1, wherein said throttle valve is provided with a full open stopper and a full close stopper, said throttle valve being held at an initial position set between an opening side limit position and a closing side limit position defined by said full open stopper and said full close stopper when said electric motor is deenergized, and wherein said throttle control unit includes a movable range estimating function estimating, on the basis of said opening side limit position and said closing side limit position, a movable range of said throttle valve within which said throttle valve is movable without abutting against said full open stopper and said full close stopper, said icing decision function is configured to set a driven range in said movable range, and to control said electric motor to drive said throttle valve within said driven range at the time of driving said throttle valve in said opening direction and said closing direction.

14. The electronic throttle control apparatus according to claim 10, wherein said movable range estimating function is configured to estimate said movable range on the basis of said opening side limit position, said closing side limit position and said initial position.

15. The electronic throttle control apparatus according to claim 13, wherein said movable range estimating function is configured to estimate said movable range on the basis of said opening side limit position, said closing side limit position and said initial position.

16. The electronic throttle control apparatus according to claim 10, wherein said movable range estimating function is configured to memorize values of opening degree of said throttle valve stopped under torque applied to move to said closing side and said opening side when said vehicle engine is being stopped, and configured to use said memorized values as said opening side limit position and said closing side limit position when said vehicle engine is started next time.

17. The electronic throttle control apparatus according to claim 13, wherein said movable range estimating function is configured to memorize values of opening degree of said throttle valve stopped under torque applied to move to said closing side and said opening side when said vehicle engine is being stopped, and configured to use said memorized values as said opening side limit position and said closing side limit position when said vehicle engine is started next time.

18. The electronic throttle control apparatus according to claim 1, wherein said throttle control unit includes a contingency avoiding function performing a contingency avoiding process for avoiding a contingency from occurring on said vehicle due to unexpected change of opening degree of said throttle valve when said deicing control function executes said freeze recovery process.

19. The electronic throttle control apparatus according to claim 18, wherein said contingency avoiding function is configured to inhibit said engine from being started by disabling at least one of an engine ignition device, a fuel injection device, and an engine starter.

20. The electronic throttle control apparatus according to claim 19, wherein said throttle control unit includes a notifying function notifying vehicle passengers that said vehicle engine is inhibited from being started when said vehicle engine is inhibited from starting by said contingency avoiding function.

21. The electronic throttle control apparatus according to claim 20, wherein said notifying function is configured to instruct by voice vehicle passengers to refrain from starting said vehicle engine.

22. The electronic throttle control apparatus according to claim 18, wherein said contingency avoiding function is configured to inhibit said vehicle from traveling by performing at least one of interrupting torque transmission from said vehicle engine to vehicle wheels and applying a braking force to said vehicle wheels.

23. The electronic throttle control apparatus according to claim 22, wherein said throttle control unit includes a notifying function notifying vehicle passengers that said vehicle is inhibited from traveling when said vehicle is inhibited from traveling by said contingency avoiding function.

24. The electronic throttle control apparatus according to claim 1, wherein said throttle control unit includes a disabling function disabling a vehicle driverts manipulation on an accelerator pedal when said deicing control function executes said freeze recovery process.

25. The electronic throttle control apparatus according to claim 1, wherein said throttle control unit includes a power control function changing from a normal level to a high level a maximum limit of electric power supplied to said electric motor when said deicing control function executes said freeze recovery process.

26. The electronic throttle control apparatus according to claim 25, wherein said power control function includes a current limiter limiting a maximum current supplied to said electric motor, and configured to set said maximum limit of electric power at said high level by disabling said current limiter.

27. The electronic throttle control apparatus according to claim 25, wherein said power control function includes a voltage booster circuit for boosting a voltage applied to said electric motor, and configured to set said maximum limit of electric power at said high level by commanding said voltage booster circuit to boost said voltage supplied to said electric motor.

28. The electronic throttle control apparatus according to claim 25, wherein said power control function is configured to set said maximum limit of electric power at said high level by interrupting power supply to actuators which operate to start said vehicle engine.

29. The electronic throttle control apparatus according to claim 2, wherein said throttle control unit includes an estimating function estimating, when said icing decision function decides that an ice piece is formed in at least one of said opening side and said closing side of said throttle valve, a size of said ice piece, on the basis of a value of opening degree of said throttle valve stopped under torque applied to move to one of said opening side and said closing side where said ice piece is present, and said deicing control function is configured to command said electric motor to generate torque for driving said throttle valve, a value of which depends on said size of said ice piece estimated by said estimating function.

30. The electronic throttle control apparatus according to claim 1, wherein said throttle control unit includes a voltage detecting function detecting a power supply voltage on which an amplitude of a drive signal which said deicing control function applies to said electric motor depends, and said deicing control function is configured to adjust said drive signal in accordance with a value of said power supply voltage detected by said voltage detecting function so that said electric motor generates a target torque.

31. The electronic throttle control apparatus according to claim 30, wherein said drive signal is a PWM signal, and said deicing control function is configured to adjust one of a duty ratio and a period of said drive signal in accordance with a value of said power supply voltage detected by said voltage detecting function.

32. The electronic throttle control apparatus according to claim 10, wherein said throttle control unit includes a recovery decision function for deciding success and failure of said freeze recovery process on the basis of a value of opening degree of said throttle valve detected by said throttle opening degree sensor during execution of said freeze recovery process by said deicing control function.

33. The electronic throttle control apparatus according to claim 20, wherein said throttle control unit includes a recovery decision function for deciding success and failure of said freeze recovery process on the basis of a value of opening degree of said throttle valve detected by said throttle opening degree sensor during execution of said freeze recovery process by said deicing control function.

34. The electronic throttle control apparatus according to claim 32, wherein said recovery decision function is configured to decide that said freeze recovery process has ended in success if opening degree of said throttle vale reaches a predetermined opening degree during execution of said freeze recovery process by said deicing control function.

35. The electronic throttle control apparatus according to claim 34, wherein said recovery decision function is configured to decide that, if opening degree of said throttle valve does not reach said predetermined opening degree during execution of said freeze recovery process by said deicing control function, said freeze recovery process has ended in failure, and said deicing control function executes again said freeze recovery process.

36. The electronic throttle control apparatus according to claim 35, wherein said deicing control function is configured to stop repeating said freeze recovery process, if opening degree of said throttle valve does not reach said predetermined opening degree after a predetermined number of executions of said freeze recovery process by said deicing control function.

37. The electronic throttle control apparatus according to claim 35, wherein said predetermined opening degree corresponds to a valve position close to said closing side limit position when said icing decision function decides that icing is present in said closing side of said throttle valve.

38. The electronic throttle control apparatus according to claim 35, wherein said predetermined opening degree is within said movable range when said icing decision function decides that icing is present in said opening side of said throttle valve.

39. The electronic throttle control apparatus according to claim 32, wherein said recovery decision function is configured to decide that said freeze recovery process has ended in success if an amount of change of opening degree of said throttle vale is larger than a predetermined value during execution of said freeze recovery process by said deicing control function.

40. The electronic throttle control apparatus according to claim 39, wherein said recovery decision function is configured to decide that, if an amount of change of opening degree of said throttle vale is not larger than said predetermined value during execution of said freeze recovery process by said deicing control function, said freeze recovery process has ended in failure, and said deicing control function executes again said freeze recovery process.

41. The electronic throttle control apparatus according to claim 40, wherein said deicing control function is configured to stop repeating said freeze recovery process, if an amount of change of opening degree of said throttle vale is not larger than said predetermined value after a predetermined number of executions of said freeze recovery process by said deicing control function.

42. The electronic throttle control apparatus according to claim 33, wherein said contingency avoiding function is configured to stop performing said contingency avoiding process, when said recovery decision function decides that said freeze recovery process has ended in success.

43. The electronic throttle control apparatus according to claim 42, wherein said notifying function is configured to notify vehicle passengers that said contingency avoiding function stops performing said contingency avoiding process.

44. The electronic throttle control apparatus according to claim 20, wherein said notifying function is configured to instruct by voice vehicle passengers to start said vehicle engine, when said contingency avoiding function stops performing said contingency avoiding process.

45. The electronic throttle control apparatus according to claim 24, wherein said disabling function is configured to enable said vehicle driver's manipulation on said accelerator pedal when said deicing control function stops executing said freeze recovery process.

46. The electronic throttle control apparatus according to claim 25, wherein said power control function is configured to change said maximum limit of electric power supplied to said electric motor from said high level set to said normal level when said freeze recovery process ends in success.

47. The electronic throttle control apparatus according to claim 36, wherein said power control function includes a fail-safe control function for performing output control of said vehicle engine in a fail-safe mode, when said deicing control stops repeating said freeze recovery process.

48. The electronic throttle control apparatus according to claim 47, wherein said fail-safe control function is configured to interrupt power supply to said electric motor, hold said throttle valve at said initial position, and perform output control on said vehicle engine so as to make up for output torque surplus or insufficiency due to inactivity of said throttle valve.

49. The electronic throttle control apparatus according to claim 47, wherein, said fail-safe control function is configured to, when said throttle valve is movable within a limited range within said movable range, drive said throttle valve within said limited range, and configured to, when a target opening degree is outside of said limited range, control output torque of said vehicle engine to make up for insufficiency or surplus of output power of said vehicle engine due to limited activity of said throttle valve.

50. The electronic throttle control apparatus according to claim 49, wherein said fail-safe control function is configured to, when a target opening degree of said throttle valve is outside of said limited range, hold said throttle valve at one of an upper limit and lower limit of said limited range so that said vehicle engine can generate a torque as close to a target torque as possible.

51. The electronic throttle control apparatus according to claim 50, wherein said electric motor is configured to generate torque depending on a duty ratio of a drive signal, and said fail-safe control function is configured to, when said throttle valve is held at one of said upper limit and lower limit of said limited range, set said duty ratio of said drive signal at a predetermined value.

52. The electronic throttle control apparatus according to claim 47, wherein said fail-safe control function is configured to perform output control of said vehicle engine while holding said throttle valve at a predetermined position.

53. The electronic throttle control apparatus according to claim 47, wherein said fail-safe control function is configured to, when output torque of said vehicle engine controlled in said fail-safe mode cannot be maintained as high as a target torque, shift open degree of said throttle valve in said opening direction.

54. The electronic throttle control apparatus according to claim 53, wherein said fail-safe control function is configured to control output power of said vehicle engine by varying at least one of ignition timing, fuel injection timing, fuel injection amount, open/close timing of inlet valves, and open/close timing of exhaust valves of said engine.

55. The electronic throttle control apparatus according to claim I, wherein said throttle control unit is configured to shift said target throttle opening degree in said opening direction when output torque of said vehicle engine becomes lower than a target output torque under low temperature environment.

56. The electronic throttle control apparatus according to claim 1, wherein said throttle control unit has a memory for storing data indicating environmental conditions when said icing decision function decides that said throttle valve is in said frozen state.

57. The electronic throttle control apparatus according to claim 56, wherein said environmental conditions include at least one of the number of occurrence of icing in said throttle valve, an ambient temperature, movable range of said throttle valve and a power supply voltage of said electric motor each time said icing decision function decides that said throttle valve is in said frozen state, success and failure of said freeze recovery process, and the number of times of driving said throttle valve to recover from said frozen state.

58. the electronic throttle control apparatus as in claim 1, wherein the driving force to move the throttle valve in the direction toward the ice to be broken is larger than the driving force to move the throttle valve in the direction opposite to the ice to be broken.

59. The electronic throttle control apparatus as in claim 1, wherein the motor is driven to detect the operating condition of the throttle valve in order to determine whether ice is present in the throttle and the freeze recovery process begins by moving the throttle valve by an amount more than the clearance of the transmission gear, and then subsequently accelerating the throttle valve toward the ice to generate a torque to better break the ice.

* * * * *